United States Patent [19]

Hayakawa

[11] Patent Number: 5,001,685

[45] Date of Patent: Mar. 19, 1991

[54] ELECTRONIC WRISTWATCH WITH GENERATOR

[75] Inventor: Motomu Hayakawa, Suwa, Japan

[73] Assignee: Seiko Espon Corporation, Japan

[21] Appl. No.: 304,289

[22] Filed: Jan. 24, 1989

[30] Foreign Application Priority Data

Jan. 25, 1988 [WO] PCT Int'l Appl. ... PCT/JP88/00053

[51] Int. Cl.[5] ..... G04B 1/00; G04C 3/00

[52] U.S. Cl. ..... 368/204; 368/203

[58] Field of Search ..... 364/205, 204

[56] References Cited

U.S. PATENT DOCUMENTS

| | | | |
|---|---|---|---|
| 4,208,869 | 6/1980 | Hanaoka | 368/84 |
| 4,634,953 | 1/1987 | Shoji et al. | 368/205 |
| 4,653,931 | 3/1987 | Takeda | 368/205 |
| 4,730,287 | 3/1988 | Yoshino et al. | 368/205 |
| 4,785,435 | 11/1988 | Inoue et al. | 368/205 |

FOREIGN PATENT DOCUMENTS

| | | |
|---|---|---|
| 52-80871 | 6/1977 | Japan . |
| 61-93979 | 5/1986 | Japan . |
| 61-124887 | 6/1986 | Japan . |
| 61-187679 | 8/1986 | Japan . |
| 61-194386 | 8/1986 | Japan . |
| 61-236326 | 10/1986 | Japan . |
| 62-66189 | 3/1987 | Japan . |

*Primary Examiner*—Bernard Roskoski

*Attorney, Agent, or Firm*—Blum & Kaplan

[57] ABSTRACT

An electronic wristwatch including an a.c. generator having an ouptut which is rectified using a half-wave rectifier. The half-wave rectified output of the generator is stored in a capacitor serving as a secondary power supply. Booster circuitry is operable for increasing and decreasing the voltage of the secondary power supply which is then applied across an auxiliary capacitor used for powering the wristwatch. Additional circuitry provides a suitable voltage across the auxiliary capacitor for driving the watch when the voltage across the secondary power supply is at or below a predetermined level. A pair of detecting circuits detect the maximum and minimum permissible voltage levels of the secondary power supply and auxiliary capacitor.

28 Claims, 17 Drawing Sheets

| BOOSTING FACTORS | SA | SB |
|---|---|---|
| X 3 | 1 | 1 |
| X 2 | 0 | 1 |
| X 1.5 | 1 | 0 |
| X 1 | 0 | 0 |

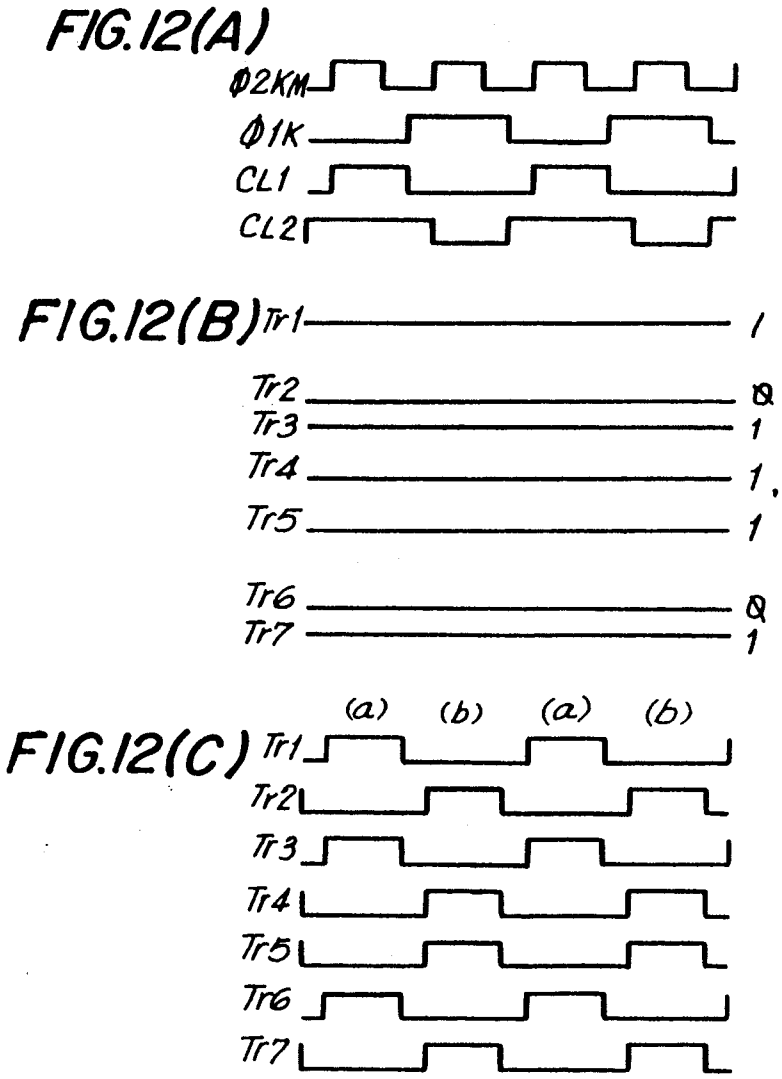
FIG.12(A)
Φ2KM
Φ1K
CL1
CL2
FIG.12(B)
Tr1
Tr2
Tr3
Tr4
Tr5
Tr6
Tr7
1
0
1
1
1
0
1
FIG.12(C)
(a)
(b)
(a)
(b)
Tr1
Tr2
Tr3
Tr4
Tr5
Tr6
Tr7
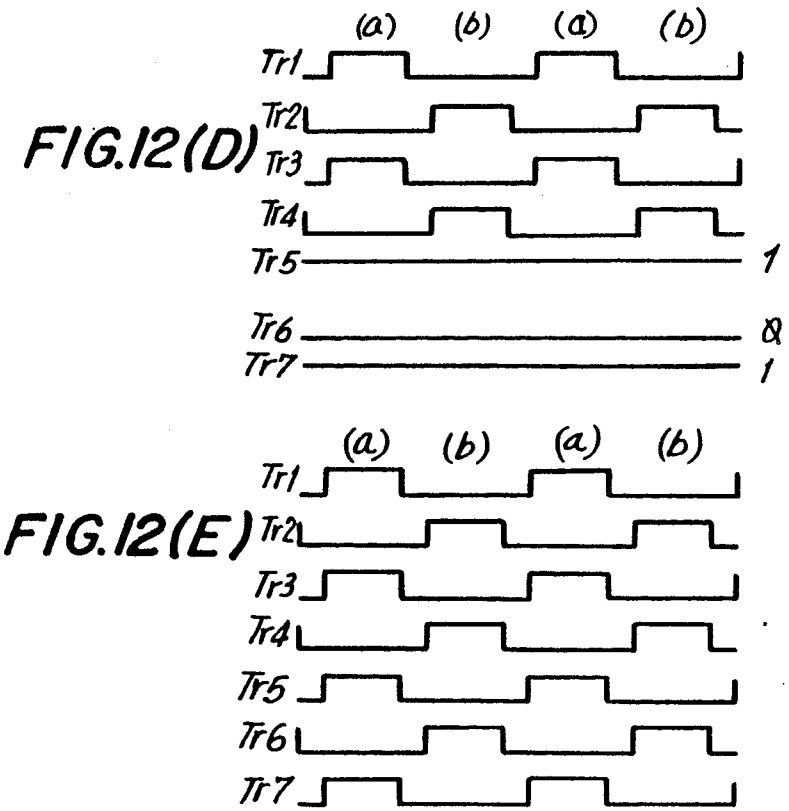
FIG.12(D)
(a)
(b)
(a)
(b)
Tr1
Tr2
Tr3
Tr4
Tr5
Tr6
Tr7
1
0
1
FIG.12(E)
(a)
(b)
(a)
(b)
Tr1
Tr2
Tr3
Tr4
Tr5
Tr6
Tr7

11
42
40
41
39
38b
38a
r1
r2
r3
35
VREG
VM
36
10
Mup
Mdown
SP1.2
SP2.0
R1.2
R2.0
φ8
φ64
φ128

ELECTRONIC WRISTWATCH WITH GENERATOR

BACKGROUND OF THE INVENTION

The present invention relates generally to an electronic timepiece, and more particularly, to an electronic wristwatch which stores power transferred by magnetic induction to a secondary power supply which in turn activates clock circuitry.

Extending the lifetime of batteries used in electronic wristwatches is a constant and major challenge. The size of batteries used in wristwatches are inherently limited by the size of the wristwatch especially in small-sized wristwatches.

Electronic wristwatches such as disclosed in U.S. Pat. No. 4,653,931, provide a relatively unlimited lifetime by using a solar battery. The solar battery is positioned on a display face such as on the dial of the wristwatch. A secondary battery or a charging capacitor is charged by the solar battery. A clock circuit is driven by the output of either the secondary battery or capacitor. Design of the wristwatch is limited since a black or blue solar battery is typically disposed on the dial. Therefore, electronic watches employing solar batteries have a limited appeal to purchasers who are attracted to a wristwatch based on its design.

Alternatively, an a.c. generator has been provided in the wristwatch with a clock circuit driven by the power generated therefrom. The a.c. electromotive force provided by the generator requires rectification. The most efficient rectifier circuit performs full-wave rectification by using a diode bridge which employs four diodes. Unfortunately, it is difficult to incorporate four diodes within the small space of a wristwatch. To ensure that the clock circuit operates continuously without error (even when the generator is in an inoperative state), the generated power must be stored in either a secondary battery or a capacitor (hereinafter referred to as the "secondary power supply") with the output therefrom used to continuously drive the clock circuit. The range of operating voltages of the clock circuit is limited. Therefore, the voltage of the secondary power supply must be maintained at a level which exceeds the lower limit of the operating voltage range of the clock circuit. The time required to charge the secondary power supply can be shortened by decreasing the storage capacity of the secondary power supply. A decrease in the storage capacity, however, accelerates the voltage lowering time (i.e. the time required to reach the lower limit) especially when the generator is in an inoperative state.

Accordingly, it is desirable to provide a rechargeable electronic wristwatch which includes an a.c. generator and which is not limited in terms of its design due to the type of secondary power source used. The clock circuitry of the electronic wristwatch should be operable over the entire voltage range of the secondary power supply. Additionally, the number of elements required for the rectifier circuit should be minimized.

SUMMARY OF THE INVENTION

Generally speaking, in accordance with the invention, an electronic wristwatch includes a generator for generating an alternating current; a half-wave rectifier for rectifying the alternating current; a rechargeable secondary power supply for storing electric power rectified by the half-wave rectifier and overcharge limiting circuitry for limiting the voltage applied to said secondary power supply by the generator. The overcharge limiting circuitry includes a diode which prevents the discharge of current from the secondary power supply due through overcharge limiting circuitry.

The half-wave rectifier includes a diode which is electrically connected in series with the rechargeable secondary power supply. A capacitor serves as the rechargeable secondary power supply.

The overcharge limiting circuitry also includes a transistor connected electrically in series with the first diode to prevent the aforementioned discharge of current therethrough. The wristwatch also includes an auxiliary capacitor for storing electric power. The capacity of the auxiliary capacitor for storing charge is typically less than the capacity of the rechargeable secondary power supply for storing charge. The wristwatch also includes clock circuitry which is driven by the voltage across the auxiliary capacitor. The secondary power supply is coupled to the auxiliary capacitor through a multistage booster circuit for transferring charge from the secondary power supply to the auxiliary capacitor.

The multistage booster circuitry is operable for increasing and decreasing the voltage applied to the auxiliary capacitor. Preferably, two or more capacitors of the multistage booster circuitry can be connected in a number of different configurations to each other and to the secondary power supply and auxiliary capacitor for increasing or decreasing the voltage which is applied to the auxiliary capacitor.

The wristwatch also includes immediate start circuitry for transferring charge to the auxiliary capacitor when the voltage of the secondary power supply is at or below a minimum permissible level. Accordingly, the watch can begin operation without requiring the auxiliary capacitor to be charged through the use of the multistage booster circuitry. The immediate start circuitry includes at least one resistor and one transistor connected electrically in parallel to each other and together connected electrically in series with the secondary power supply. When the multistage booster circuitry is turned off, the voltage across the immediate start circuitry and secondary power supply is impressed across the auxiliary capacitor and is at a voltage level within the operating range of the clock circuitry.

The wristwatch also includes two detecting circuits. The first detecting circuit detects when a maximum permissible voltage level and a minimum permissible voltage level of the secondary power supply occurs. The overcharge limiting circuitry is responsive to the occurrence of the maximum permissible voltage level for limiting the voltage applied to the secondary power supply by the generator. The second voltage detecting circuit detects when the maximum permissible voltage level and minimum permissible voltage level are applied to the auxiliary capacitor. The booster control circuitry is responsive to both the occurrence of the maximum permissible level and minimum permissible level of voltage across the auxiliary capacitor for decreasing and increasing the voltage applied by the multistage booster circuit to the auxiliary capacitor, respectively. Consequently, the booster control circuitry will maintain the voltage applied to the auxiliary capacitor within the operating range for driving the clock circuitry.

Accordingly, it is an object of the invention to provide an electronic wristwatch having an a.c. generator and which is not limited in terms of its design due to the type of secondary power supply used.

It is another object of the invention to provide an improved electronic wristwatch with an a.c. generator having clock circuitry which is operable over the entire voltage range of the secondary power supply.

It is a further object of the invention to provide an improved electronic wristwatch with an a.c. generator requiring the minimum number of elements for rectification.

It is yet another object of the invention to provide an electronic wristwatch having a relatively short period of time required for charging the secondary power supply and a relatively long period of time of operation prior to requiring recharge of the secondary power supply compared to conventional electronic wristwatches with a.c. generators.

Still other objects and advantages of the invention will in part be obvious and will in part be apparent from the specification.

The invention accordingly comprises the features of construction, combination of elements and arrangements of parts which will be exemplified in the construction hereinafter set forth and the scope of the invention will be indicated in the claims.

BRIEF DESCRIPTION OF THE DRAWINGS

FIG. 12(A) illustrates input signals supplied to and output signals produced by a boosting reference generating circuit;

FIGS. 12(B), 12(C), 12(D) and 12(E) are timing diagrams of clock signals and voltage waveforms appearing across transistors Tr1–Tr7 of FIG. 10

DESCRIPTION OF THE PREFERRED EMBODIMENTS

Figure 1:
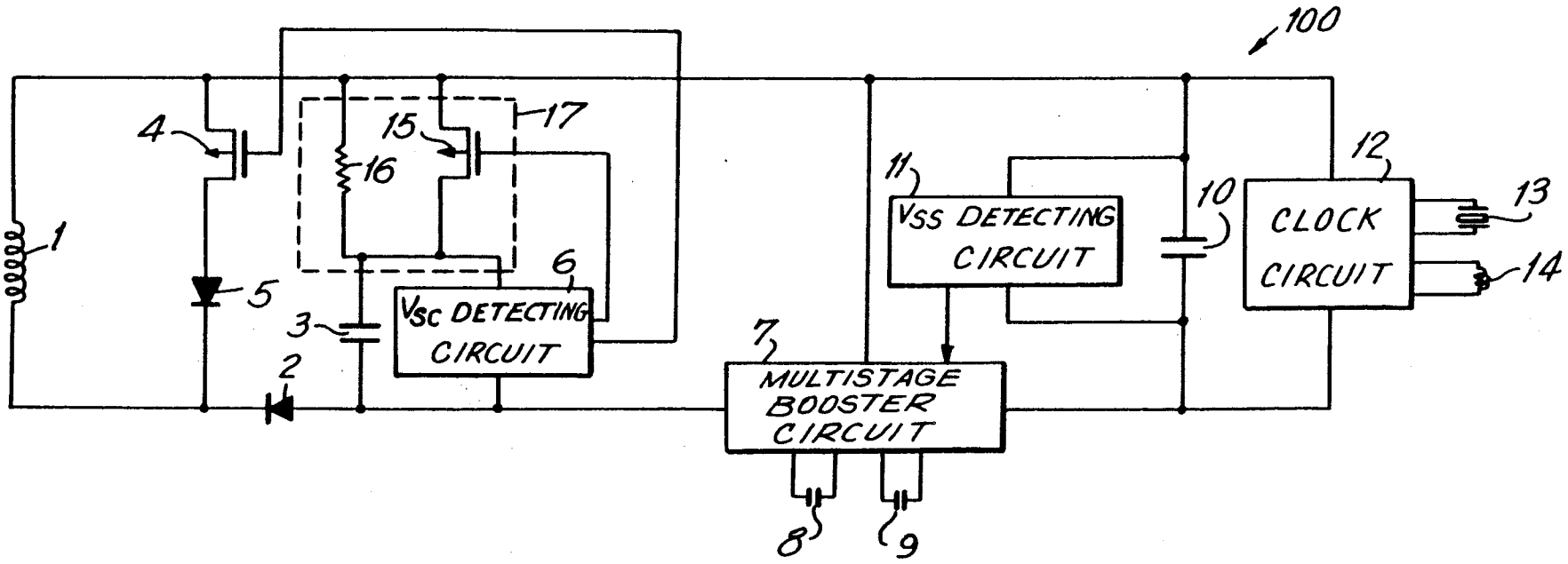
FIG. 1 is a block and circuit diagram of an electronic wristwatch in accordance with the invention.

FIG. 1 illustrates a general circuit 100 of a generating electronic wristwatch which includes a generator coil 1 across which an a.c. voltage is induced by a generator (not shown). A rectifier diode 2 subjects the a.c. induced voltage to half-wave rectification and charges a high-capacitance capacitor 3, referred to as a secondary power supply, with the rectified power. A limiter transistor 4 prevents overcharging of capacitor 3 and is turned on when the voltage of capacitor 3 (hereinafter defined as $V_{SC}$) reaches a predetermined voltage $V_{lim}$.

When limiter transistor 4 is turned on, current produced by coil 1 substantially bypasses capacitor 3. Voltage $V_{Lim}$ is set at a level above the maximum value of the voltage required for operation of a clock circuit 12 and within the range of the rated voltage of capacitor 3. A reverse-current preventing diode 5 prevents reduction in the generation efficiency which would otherwise occur due to an increase in the electromagnetic brake based on the flow of a reverse current, as described below. A multistage booster circuit 7 transfers the charge stored in capacitor 3 to an auxiliary capacitor 10 by switching the connections between booster capacitors 8 and 9, capacitor 3 and auxiliary capacitor 10. Boosting of the voltage applied to auxiliary capacitor 10 results. Typically, the capacity of auxiliary capacitor 10 for storing charge is less the capacity of capacitor 3 for storing charge.

Multistage booster circuit 7 includes four boosting factors (i.e. boosting factors of 3 times, 2 times, 1.5 times and 1 time voltage $V_{SC}$). The boosted voltage is applied to auxiliary capacitor 10 for charging of the latter. Circuit 7 is operable for producing a voltage $V_{SS}$ (i.e. the value of the voltage applied to auxiliary capacitor 10). Multistage booster circuit 7 ensures that the level of the operating voltage of circuit 100 is optimized. A $V_{SS}$ detecting circuit 11 monitors the voltage across auxiliary capacitor 10 and uses two different reference voltages $V_{up}$ and $V_{down}$ which are related to each other as follows:

$$V_{up} < V_{down}$$

$V_{SS}$ detecting circuit 11 outputs the result of its detection to multistage booster circuit 7. When the level of $V_{SS}$ exceeds the value of $V_{down}$, the boosting factor is lowerd. When the level of $V_{SS}$ is below the value of $V_{up}$, the boosting factor is raised.

A clock circuit 12 incudes an oscillation circuit (not shown) for driving a crystal oscillator 13 having an original frequency of 32,768 Hz, a frequency divider circuit (not shown), and a motor driving circuit (not shown) for driving a motor coil 14. Clock circuit 12 operates at a voltage $V_{SS}$. Motor coil 14 drives a stepping motor (not shown) for rotating a pointer (not shown).

An immediate start circuit 17 includes a shorting transistor 15 and a series resistor 16. When the level of $V_{SC}$ is lower than a predetermined voltage $V_{on}$, an immediate start operation is performed which will be described in detail below.

A $V_{SC}$ detecting circuit 6 detects when the level of $V_{SC}$ has reached either voltage $V_{Lim}$ or $V_{on}$. Voltages $V_{on}$, $V_{up}$, $V_{down}$ and $V_{Lim}$ are related to each other as follows:

$$V_{on}<V_{up}<V_{down}<V_{Lim}$$

A detailed description of the operation of each section of circuit 100 now will be discussed.

Figure 2:
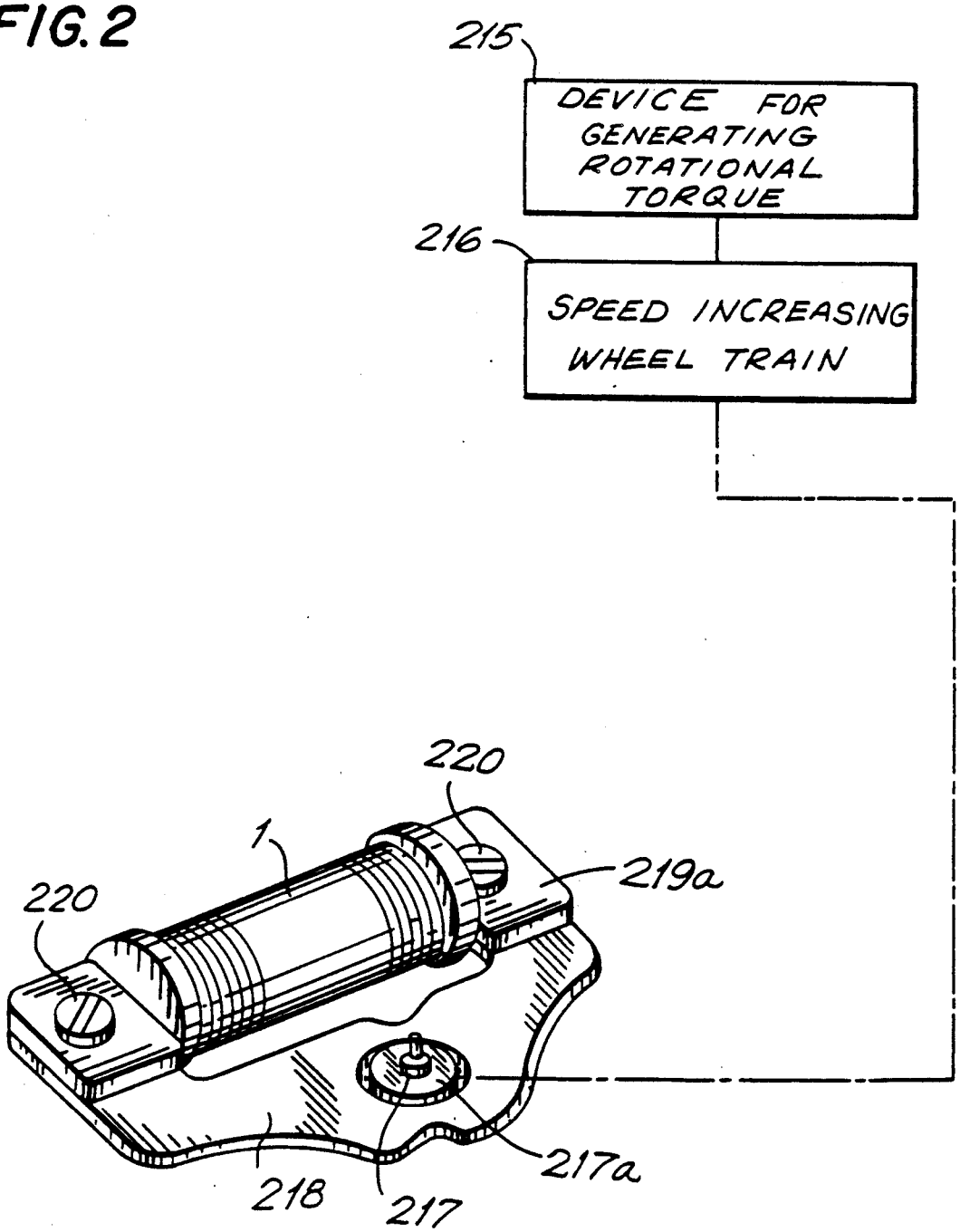
FIG. 2 illustrates a block diagram of a motor and a fragmented perspective view of an a.c. generator.

The principle of a.c. generation is illustrated in FIG. 2. An oscillating device 215 for generating rotational torque includes an oscillating weight in which the center of rotation and the center of gravity are eccentric with respect to each other. The speed of rotation of oscillating device 215 is increased by a speed increasing wheel train 216. A rotor 217 is coupled to wheel train 216. As the speed of wheel train 216 increases, the speed at which rotor 217 rotates increases. Rotor 217 includes a permanent magnet 217*a*. A stator 218 surrounds rotor 217. Coil 1 is wound on a core 219*a*. Stator 218 and core 219*a* are rigidly secured to each other by a plurality of screws 220. Rotation of rotor 217 induces an electromotive force in coil 1 as follows:

$$e=N(d\Theta/dt)$$

The current produced by coil 1 is as follows:

$$i=e/(R^2+(WL)^2)^{\frac{1}{2}}$$

wherein

N: number of turns of coil 1

Θ: strength of the magnetic flux passing through a core 219*a* of coil 1

T: time

R: resistance of coil 1

W: speed of rotation of rotor 217

L: inductance of coil 1

Electromotive force e is an alternating voltage having a substantially sinusoidal pattern. Rotor 217 and stator 218, which surrounds rotor 217, define concentric circles. Stator 218 surrounds permanent magnet 217 a of rotor 217 over substantially its entire circumference. Rotation of rotor 217 can be halted by minimizing the attractive forces (i.e. attractive torque) between stator 218 and rotor 217. Accordingly, rotor 217 can be halted at any desired position within its circular path.

The a.c. voltage produced by generator coil 1 is rectified and charges capacitor 3. Rectification is achieved using a half-wave rectifier employing a simple diode arrangement. Generator coil 1, as shown in FIG. 2, and use of a half-wave rectifier provides the same level of generation efficiency as provided by employing a full-wave rectifier as will be explained below.

Figure 3A:
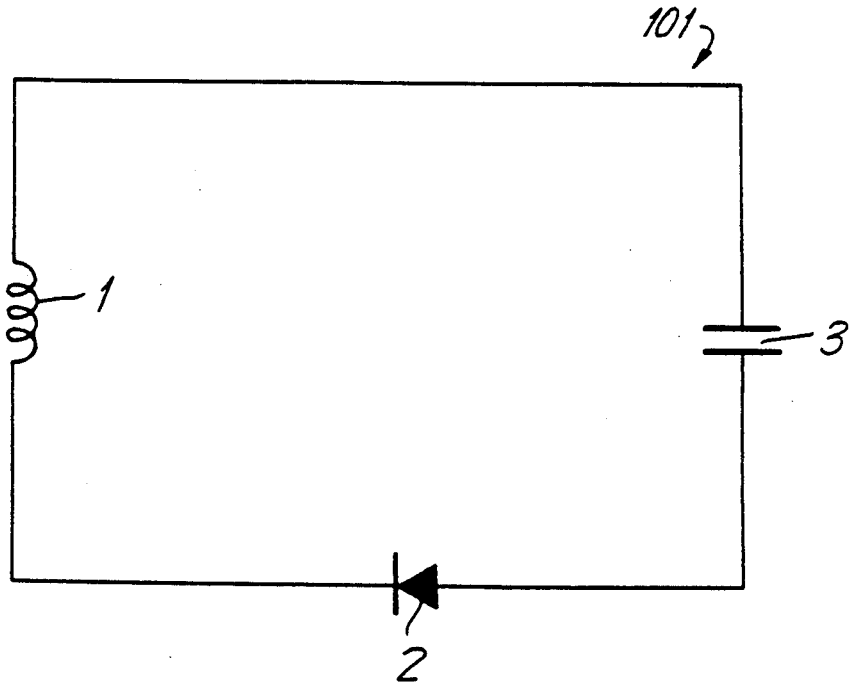
FIG. 3(A) is a half-wave rectifier circuit in accordance with the invention.
Figure 3B:
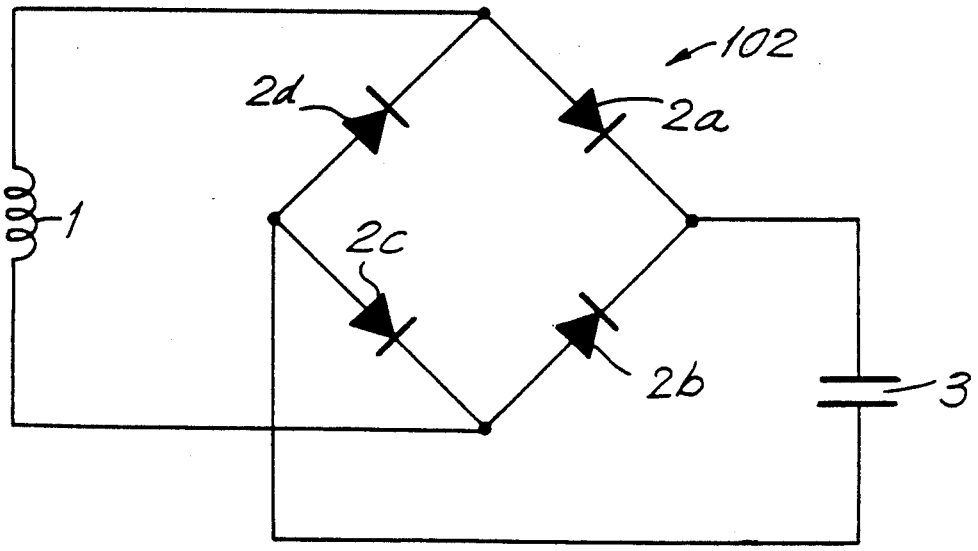
FIG. 3(B) PRIOR ART
FIG. 3(B) is a conventional full-wave rectifier circuit.

FIGS. 3(A) and 3(*b*) show a half-wave rectifier circuit 101 in accordance with the invention and a conventional full-wave rectifier circuit 102, respectively. Circuit 101 includes generator coil 1, diode 2 and capacitor 3. Circuit 102 includes generator coil 1, a diode bridge having diodes 2*a*, 2*b*, 2*c* and 2*d* and capacitor 3. In half-wave rectifier circuit 101, shown in FIG. 3(A), only one diode 2 is interposed in the charging loop. In full-wave rectifier circuit 102, shown in FIG. 3(B), two diodes are interposed in the charging loop. The voltage drop across the two diodes in the charging loop (i.e. diodes 2*a* and 2*c* or 2*b* and 2*d*) under full-wave rectification is twice as large as the voltage drop in the charging loop under half-wave rectification.

Figure 4:
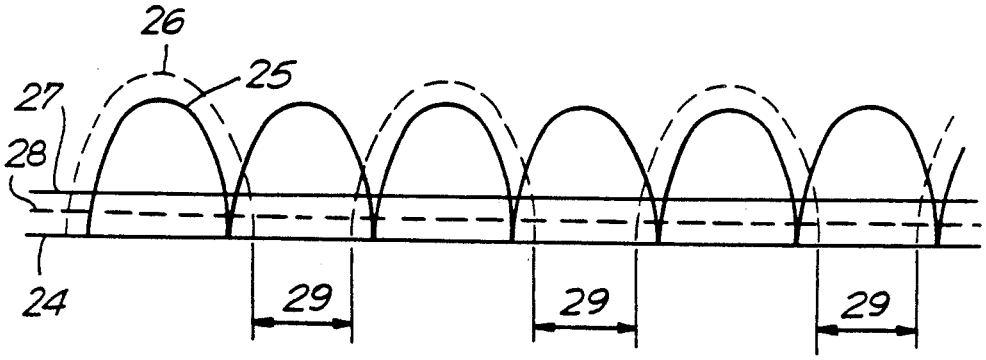
FIG. 4 is a plot of generated currents.

FIG. 4 graphically compares the current waveforms under these two rectification methods. The voltage drop across diode 2 in half-wave rectifier circuit 101 is represented by the difference between a line 28 and a reference line 24. The voltage drop across either diodes 2*b* and 2*d* or 2*a* and 2*c* in full-wave rectifier circuit 102 is represented by the difference between a line 27 and reference line 24. Accordingly, a current waveform 26 flowing in half-wave rectifier 101 in accordance with the invention has a higher peak value than a current waveform 25 flowing in full-wave rectifier 102 as used in the prior art. The amount of charge stored in the accumulator means (i.e. capacitor 3) corresponds to the area enveloped above reference line 24 by current waveform 25 and line 27. The amount of charge stored in capacitor 3 in accordance with the invention corresponds to the area above reference line 24 enveloped by waveform 26 and line 28. There is substantially no difference between these two areas, that is the charging (i.e. accumulation) performances of circuits 101 and 102 are substantially the same. The reason why there is no difference in terms of the accumulation performance between conventional full-wave rectification and the half-wave rectification is as follows:

During a period 29 when no current flows (i.e. current flow is cut off) in half-wave rectifier circuit 101, no current flows through coil 1. Accordingly, the brake torque applied to rotor 217 is small. Movement of the oscillating weight accelerates. More specifically, during period 29, the energy is stored in the form of kinetic energy of the oscillating weight and released when power is generated. For this reason, the peak value of current waveform 26 is greater than that of current waveform 25. Advantageously, by using only one rather than two diodes, that is, by halving the number of diodes required, the voltage drop across the rectifier is halved. As a result, despite the half-wave rectification, the generation and accumulation performances of half-wave rectifier circuit 101 are substantially comparable to the generation and accumulation performances of full-wave rectifier 102.

The invention generates an acceptable level of voltage across coil 1 using half-wave rectification while significantly reducing the number of diodes required (i.e. from four diodes in the case of a diode bridge to one diode). An electronic wristwatch having greater space efficiency at a reduced cost results.

Figure 5:
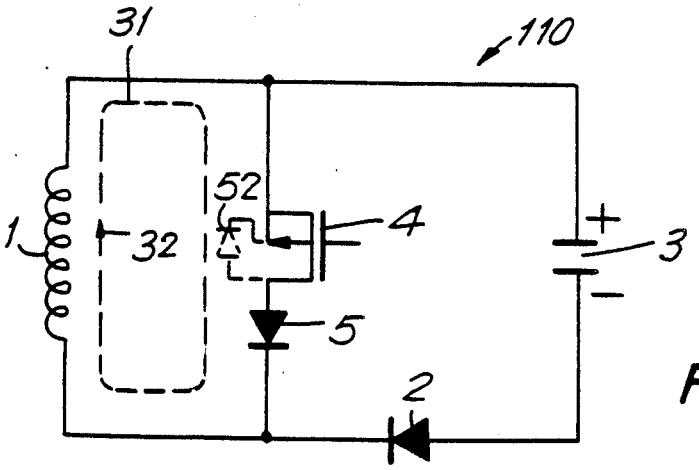
FIG. 5(A) is a combined limiter and rectifier circuit in accordance with the invention.
FIG. 5(B) is a prior art limiter and rectifier circuit.
Figure 5:
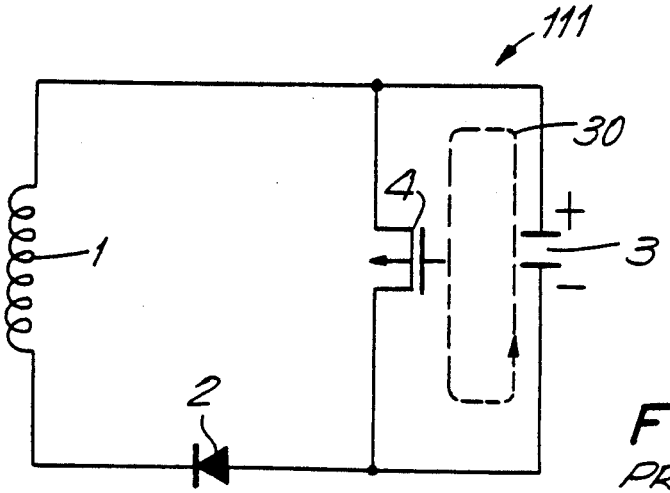
FIG. 5 (B) PRIOR ART

The configuration of a limiter circuit 110 in accordance with the invention is shown in FIG. 5(A). FIG. 5(B) illustrates a conventional limiter circuit 111. Limiter circuit 110 includes a limiter transistor 4 operable for bypassing the current produced by coil 1. In one preferred embodiment of the invention, limiter transistor 4 is a P-channel MOSFET. Integrated circuits (ICs) for watches require a low power consumption and are produced using a C-MOS process. Therefore, limiter transistor 4 is made as a MOSFET within the IC, which advantageously increases space efficiency and lowers manufacturing cost compared to use of an external element provided outside the IC.

The conventional limiter method is shown in FIG. 5(B). Limiter transistor 4 is connected in parallel to capacitor 3 and when turned on allows the charge stored in capacitor 3 to undesirably discharge along a path denoted by a dashed line 30. Limiter transistor 4 in circuit 110 prevents overcharging of capacitor 3. Limiter transistor 4 in circuit 111, however, permits the discharge of excess charge from capacitor 3. Although it might first appear that the prior art arrangement of circuit 111 poses no problem if limiter transistor 4 is left turned on, the charge stored in capacitor 3 can discharge to an undesirable level.

To avoid this problem, the voltage across capacitor 3 must be constantly monitored with limiter transistor 4 being immediately turned off when voltage $V_{SC}$ falls below $V_{Lim}$. With a voltage detecting circuit constantly monitoring voltage $V_{SC}$, the amount of current required by the reference voltage generating circuit and comparator circuit of the voltage detecting circuit increases significantly. Another disadvantage of circuit 111 arises when limiter transistor 4 is turned on. High levels of voltage $V_{SC}$ of capacitor 3 are directly applied to limiter transistor 4 resulting in a large current flow through the limiter transistor 4. To prevent breakdown of limiter transistor 4, limiter transistor 4 must have a high current rating leading to a transistor of extremely large size. An increase in the size of the IC results leading to an undesirable increase in manufacturing cost.

To avoid these drawbacks, the invention includes a reverse current preventing diode 5 connected electrically in series with limiter transistor 4 as shown in FIG. 5(A). When limiter transistor 4 is turned on, the charge stored in capacitor 3 cannot be due to rectifier diode 5. Accordingly, even after voltage $V_{SC}$ has reached $V_{Lim}$, voltage $V_{SC}$ varies only at a rate corresponding to the rate of consumption of charge in clock circuit 12. A gradual decreasing curve of charge stored in capacitor 3 results. It is unnecessary to activate $V_{SC}$ detecting circuit 6 at all times. In other words, it is only necessary to intermittently drive $V_{SC}$ detecting circuit 6 in a sampling manner. Minimization in the amount of current required by the reference voltage generating circuit and comparator circuit of $V_{SC}$ detecting circuit 6 results. Large flows of current through limiter transistor 4 are prevented by circuit 110. The size of limiter transistor 4 need not be increased as in circuit 111.

An arrow 32 of dashed line 31 of circuit 110 indicates the direction of current bypassed by limiter transistor 4. It is only necessary to cut off the supply of current from coil 1 after voltage $V_{SC}$ has reached voltage $V_{Lim}$. A parasitic diode 52 exists between the substrate and the drain of limiter transistor 4. If there were no reverse current diode 5, a current would flow in the direction reverse to arrow 32 of dashed line 31 at the time coil 1 generates power even when limiter transistor 4 is turned off. Under such circumstances, the brake torque of generator coil 1 would increase (as described above), resulting in a lowering of generation efficiency. Reverse current preventing diode 5 prevents such lowering of efficiency by preventing the consumption of power by circuit 110 when limiter transistor 4 is turned off. Consequently, a lower power consumption by the intermittent activation of voltage detecting circuit 6, reduction in the size of limiter transistor 4 and securing a higher level of generation performance by adding reverse current preventing diode 5 in circuit 110 results. Limiter circuit 110 also can be used when a bipolar transistor is employed as limiter transistor 4 (i.e. the switching element).

Figure 6A:
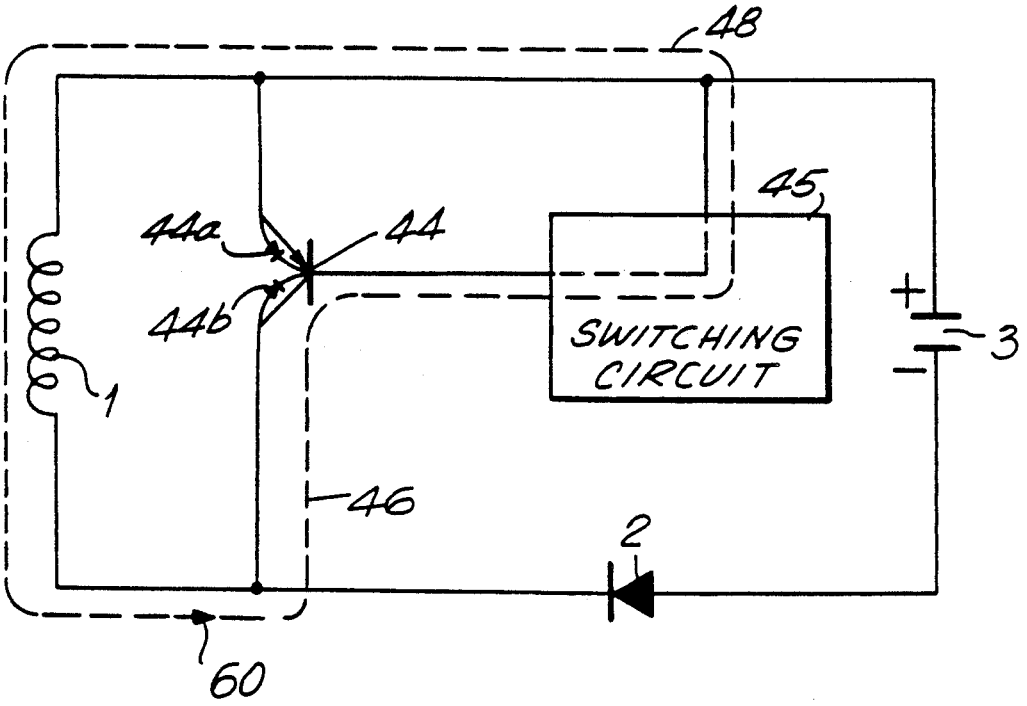
FIG. 6(A) PRIOR ART
FIG. 6(A) is a prior art limiter circuit which includes a PNP type transistor.
Figure 6B:
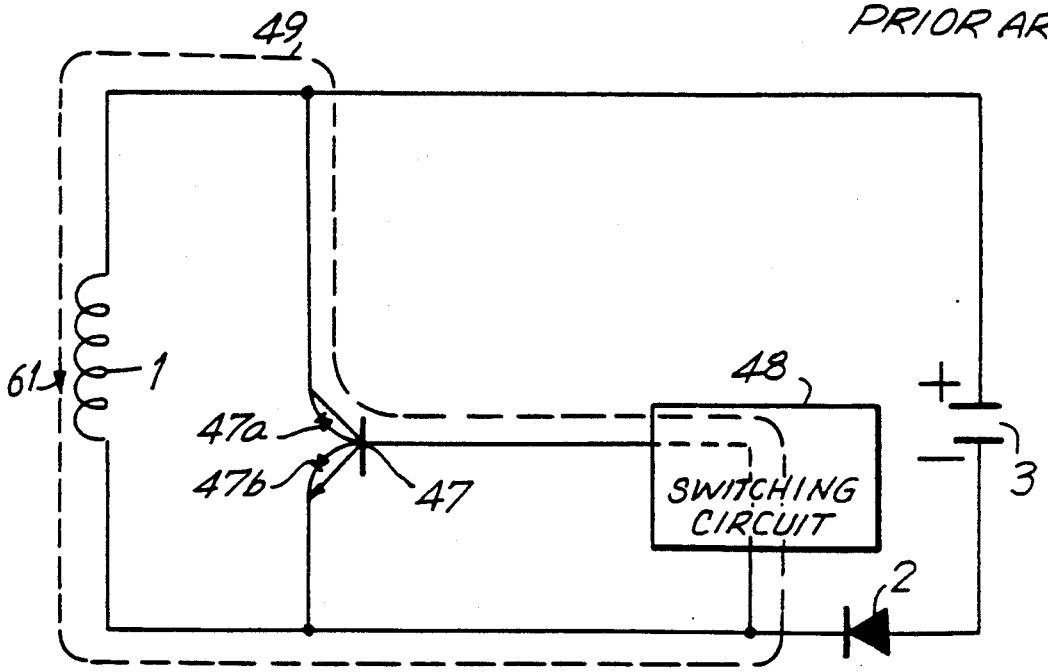
FIG. 6(B) PRIOR ART
FIG. 6(B) is a prior art limiter circuit which includes an NPN type transistor.

FIGS. 6(A) and 6(B) show conventional limiter circuits 48 and 49 in which bipolar transistors are employed as the switching elements and no reverse current preventing elements are provided, respectively. FIG. 6(A) includes a PNP type bipolar transistor 44 as the switching element. FIG. 6(B) includes an NPN type bipolar transistor 47 as the switching element. As shown in FIG. 6(A), when PNP type transistor 44 is turned off, a reverse current flow in a direction denoted by an arrow 60 along a dashed path 46 is created. Undesirably, the current flows through a diode 44*b* formed between a collector and a base of PNP type transistor 44 and through a switching control circuit 45. Another diode 44*a* is formed between the emitter and base of PNP type transistor 44. Switching control circuit 45 controls whether the base of PNP type transistor 44 is switched to the higher potential side of transistor 44 (i.e. the same potential as the emitter of PNP type transistor 44) to turn off PNP type transistor 44. Similarly, as shown in FIG. 6(B), a reverse current flow in a direction denoted by an arrow 61 along a dashed path 49 undesirably flows through a diode 47*a* formed between a base and a collector of NPN type transistor 47 and a switching control circuit 48. Another diode 47*b* is formed between an emitter and base of NPN type transistor 47. Switching control circuit 48 controls whether the base and emitter of NPN-type transistor 47 are at the same voltage level to turn off transistor 47.

Figure 7A:
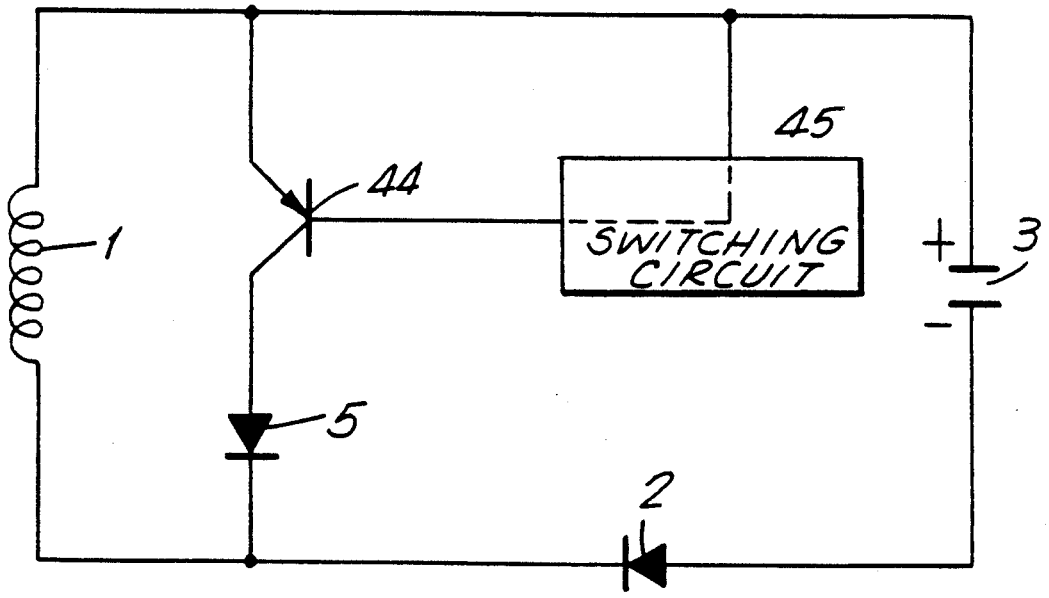
FIG. 7(A) is a limiter circuit which includes a PNP type transistor in accordance with the invention.
Figure 7B:
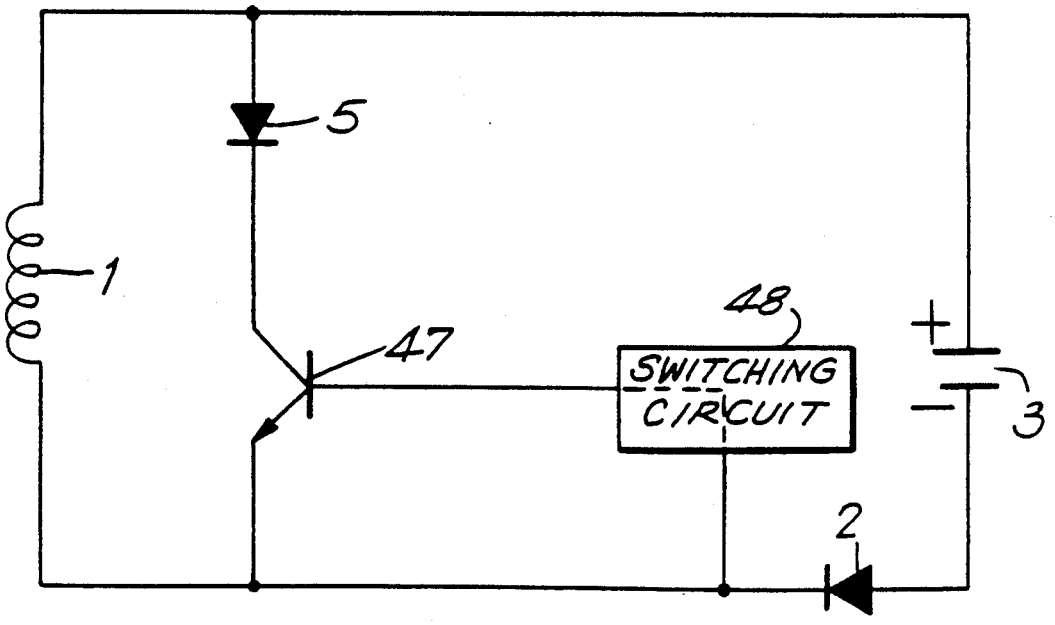
FIG. 7(B) is a limiter circuit which includes an NPN type transistor in accordance with the invention.

FIGS. 7(A) and 7(B) illustrate an alternative embodiment of the invention which overcomes the reverse current flow drawbacks of FIGS. 6(A) and 6(B). More particularly, in FIGS. 7(A) and 7(B) a reverse current preventing diode 5 is connected electrically in series to either bipolar transistor 44 or bipolar transistor 47, respectively. Consequently, a limiter circuit is provided without lowering generation performance by cutting off the flow of reverse current through transistor 44 or 47.

Figures 8, 11:
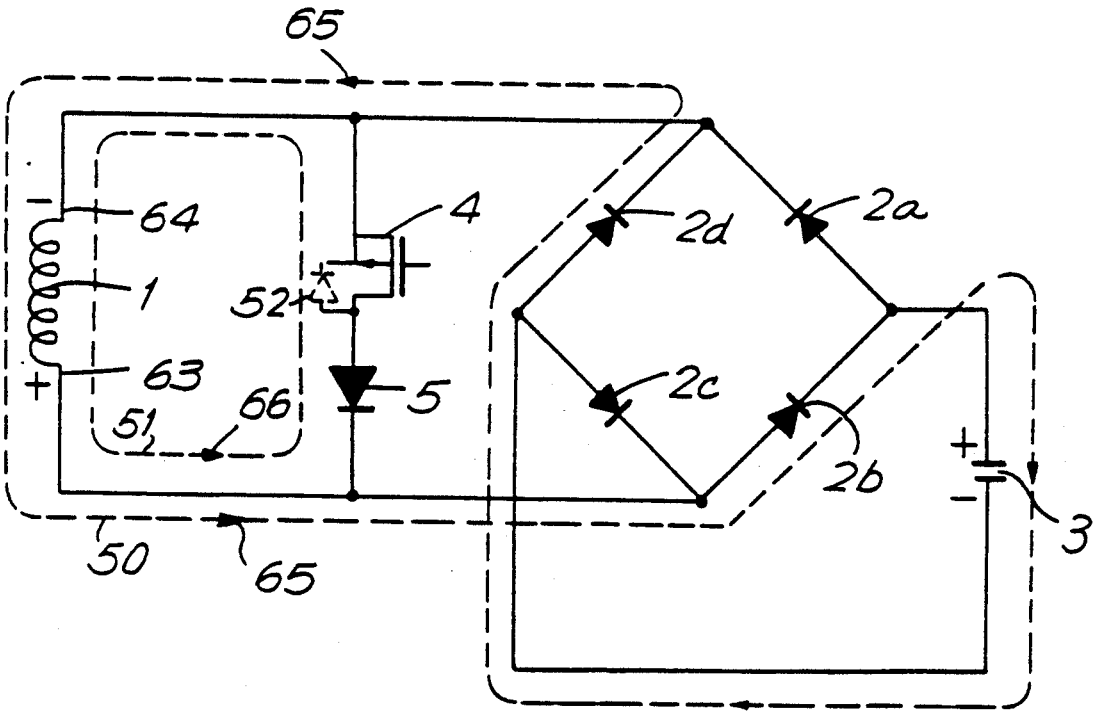
FIG. 8 is a limiter circuit connected to a full-wave rectifier circuit in accordance with the invention.
FIG. 11 is a table illustrating a method of assigning logic values to boosting factors of FIG. 10.

The configuration of the limiter circuit in accordance with the invention also can be used in a full-wave rectifier circuit which employs a diode bridge. One embodiment of the invention including the full-wave rectifier is shown in FIG. 8. When the induced voltage produced by generator coil 1 has a higher potential at a lower end 63 than at a higher end 64, the current normally flows in a direction denoted by an arrow 65 along a dashed path 50. Assuming that the reverse current preventing diode 5 is not provided, the current undesirably flows in a direction denoted by an arrow 66 along a dashed path 51 through a parasitic diode 52 even when limiter transistor 4 is turned off. Consequently, current for only one half (i.e. one side) of the full-wave rectification is stored in capacitor 3. Charging performance of capacitor 3 is halved. Reverse current preventing diode 5 prevents the flow of current along path 51 ensuring that current flows along path 50. Effective full-wave rectification results.

Figure 9:
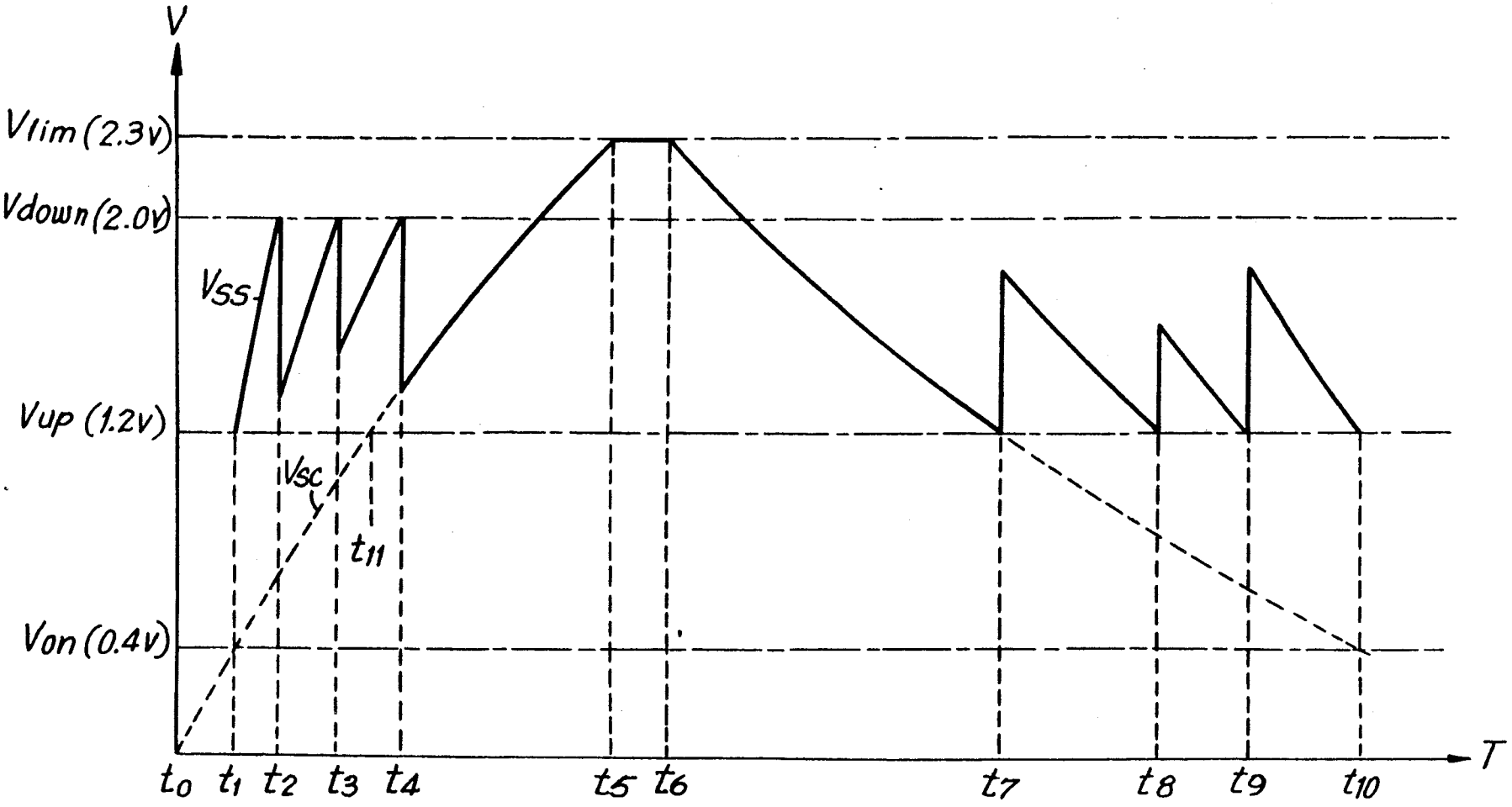
FIG. 9 is a plot of voltages $V_{SS}$ and $V_{SC}$ vs. time in connection with a multistage booster circuit.

A graphic description of multistage boosting is illustrated in FIG. 9. The abscissa axis represents time and the ordinate axis represents voltage. Voltage $V_{SC}$ of capacitor 3 is shown as a dashed line and voltage $V_{SS}$ of auxiliary capacitor 10 is shown as a solid line. Voltages $V_{on}$, $V_{up}$, $V_{down}$ and $V_{Lim}$ are set as follows:

$$V_{on}=0.4\ V$$

$$V_{up}=1.2\ V$$

$$V_{down}=2.0\ V$$

$$V_{Lim}=2.3\ V$$

During the time interval from $t_0$ to $t_6$, generator coil 1 is for the most part in an operative state and is defined as the charging period for capacitor 3. During the time interval after time $t_6$, generator coil 1 is assumed to be in an inoperative state and is defined as the discharging period for capacitor 3. It should be noted that, although in FIG. 9 both the charging and discharging periods of capacitor 3 are drawn on the same time scale, in actual practice the charging period is on the order of several minutes, while the discharging period is on the order of several days. After the time interval $t_0$–$t_1$ and after a time $t_{10}$, circuit 100 is in an immediate start state, which will be discussed in detail below.

As voltage $V_{SC}$ exceeds 0.4 V (after time $t_1$) a three time boosting state is begun resulting in a voltage of $3\times V_{SC}$ being applied to auxiliary capacitor 10 as voltage $V_{SS}$ (i.e. a boosting factor of 3). As charging of capacitor 3 and auxiliary capacitor 10 continues, voltage $V_{SS}$ of auxiliary capacitor 10 reaches 2.0 V at time $t_2$. The boosting factor is now stepped down by one level to $2\times V_{SC}$ (i.e. boosting factor of 2). Thereafter, as charging of capacitor 3 and auxiliary capacitor 10 continues, voltage $V_{SS}$ reaches 2.0 V at times $t_3$ and $t_4$. Each time voltage $V_{SS}$ reaches 2.0 V, the boosting factor is stepped down by one level, that is, during time intervals $t_1$–$t_2$, $t_2$–$t_3$, $t_3$–$t_4$ and $t_4$–$t_7$ the boosting factos are 3 (i.e. $3\times V_{SC}$), 2 (i.e. $2\times V_{SC}$), 1.5 (i.e. $1.5\times V_{SC}$) and 1.0 (i.e. $1.0V_{SC}$), respectively. During time period $t_4$–$t_7$ when the boosting factor is 1.0, voltages $V_{SS}$ and $V_{SC}$ are equal (i.e. $V_{SC}=V_{SS}$). Therefore, during period $t_4$–$t_7$, even though voltage $V_{SS}$ reaches 2.0 V, the boosting factor is not changed. During time interval $t_5$–$t_6$ when voltages $V_{SC}$ and $V_{SS}$ reach 2.3 V (i.e., $V_{SC}=V_{SS}=2.3$ V), limiter transistor 4 is turned on to prevent voltage $V_{SC}$ and therefore $V_{SS}$ from rising above 2.3 V.

During the discharging period (i.e. after time $t_6$), the boosting factors are changed again once voltage $V_{SS}$ decreases to 1.2 V. More specifically, once voltage $V_{SS}=1.2$ V, the boosting factor is stepped up by one level to 1.5 (i.e. $1.5\times V_{SC}$). Thereafter, each time $V_{SS}$ reaches 1.2 V, the boosting factor is stepped up by one level. For example, the boosting factor is 1.5 during time interval $t_7$–$t_8$; 2.0 during time interval $t_8$ to $t_9$; and 3.0 during time interval $t_9$ to $t_{10}$. The foregoing boosting system ensures that voltage $V_{SS}$, which serves as the voltage of the power supply for driving the watch, will be at 1.2 V or greater whenever $V_{SC}\geqq 0.4$ V. Extension of the operating time of the watch results.

Voltage $V_{up}$ (i.e. 1.2 V) is set at the lowest level of operating voltage for a stepping motor of a hand of the watch (not shown). Without a voltage boosting system, voltage $V_{SC}$ would serve as the driving voltage for the stepping motor. The watch would be operable during the time period when $V_{SC}=1.2$ V or greater (i.e., from a time $t_{11}$ when $V_{SC}$ first reaches 1.2 V until time $t_7$ when $V_{SC}$ falls below 1.2 V). The watch otherwise would be operable only during the charging period. The time required for the watch to begin to operate would be longer. During the discharging period, the time elapsed until the watch stops would be shorter. Consequently, a watch without a boosting system is extremely undesirable. Voltage $V_{on}$ is set to satisfy the condition of $V_{on}\times 3\geqq V_{up}$, that is, to ensure that when the boosting factor is 3.0, the boosted voltage applied to auxiliary capacitor 10 is at least 1.2 volts. Voltage $V_{Lim}$ is set slightly below the breakdown voltage of capacitor 3. In this embodiment of the invention, $V_{Lim}$ is 2.3·V and the breakdown voltage of capacitor 3 is 2.4 V.

Changing from one boosting factor to another (hereinafter referred to as "changeover") is effected by comparison of $V_{SS}$ with $V_{up}$ and $V_{down}$. Three detection voltages contribute to the changeover of boosting factors in the invention, that is, voltage $V_{on}$ for the changeover between the immediate start state and providing a boosting factor of 3.0 and voltages $V_{up}$ and $V_{down}$. Otherwise, determination of when to change from one boosting factor to another requires detection of voltage $V_{SC}$ for four different voltages. These four different voltages (i.e. four changeover points) are immediate start ⟷ boosting factor 3.0, boosting factor 3.0 ⟷ boosting factor 2.0, boosting factor 2.0 ⟷ boosting factor 1.5 and boosting factor 1.5 ⟷ boosting factor 1.0. In other words, to ensure voltage $V_{SS}$ obtained by boosting voltage $V_{SC}$ is equal to or greater than voltage $V_{up}$ (i.e. 1.2 V), it would be necessary to provide detection of voltage $V_{SC}$ as follows:

| | |
|---|---|
| Immediate start ⟷ 3-time boosting | 0.4 V |
| 3-time boosting ⟷ 2-time boosting | 0.6 V |
| 2-time boosting ⟷ 1.5-time boosting | 0.8 V |
| 1.5-time boosting ⟷ 1-time boosting | 1.2 V |

In accordance with the invention, however, the number of voltages required to be detected is reduced by one resulting in reduction in the chip area of the IC. Further, even when the lowest operating level of voltage $V_{SS}$ is changed for reasons of the design or driving conditions, the invention requires only a change in the values of two detected voltages, that is, $V_{on}$ (0.4 V) and $V_{up}$ (1.2 V). In a system in which changeover is effected by detection of voltage $V_{SC}$, all four detected voltages need to be changed. Adjustment to the detected voltages is provided by using detection voltage adjusting terminals protruding from the IC. A relatively large number of adjusting terminals are generally required in conventional watches. In accordance with the invention, however, the number of adjusting terminals required can be reduced. An increase in the chip area of the IC is thereby prevented.

Although the foregoing embodiment of the invention included four boosting factors, by increasing the number of boosting capacitors (i.e. capacitors 8 and 9) to, for example, three, eight different boosting factors can be obtained, namely, 1.0, $1\frac{1}{3}$, 1.5, $1\frac{2}{3}$, 2.0, 2.5, 3.0 and 4.0. Where the boosting system requires detection of $V_{SC}$ to determine changeover, detection of voltage $V_{SC}$ corresponding to the changeover between all eight boosting factors is required. The invention, however, does not require provision of an additional detection voltage. Thus, the invention permits the booster circuit to be readily graded upwardly.

Figure 10:
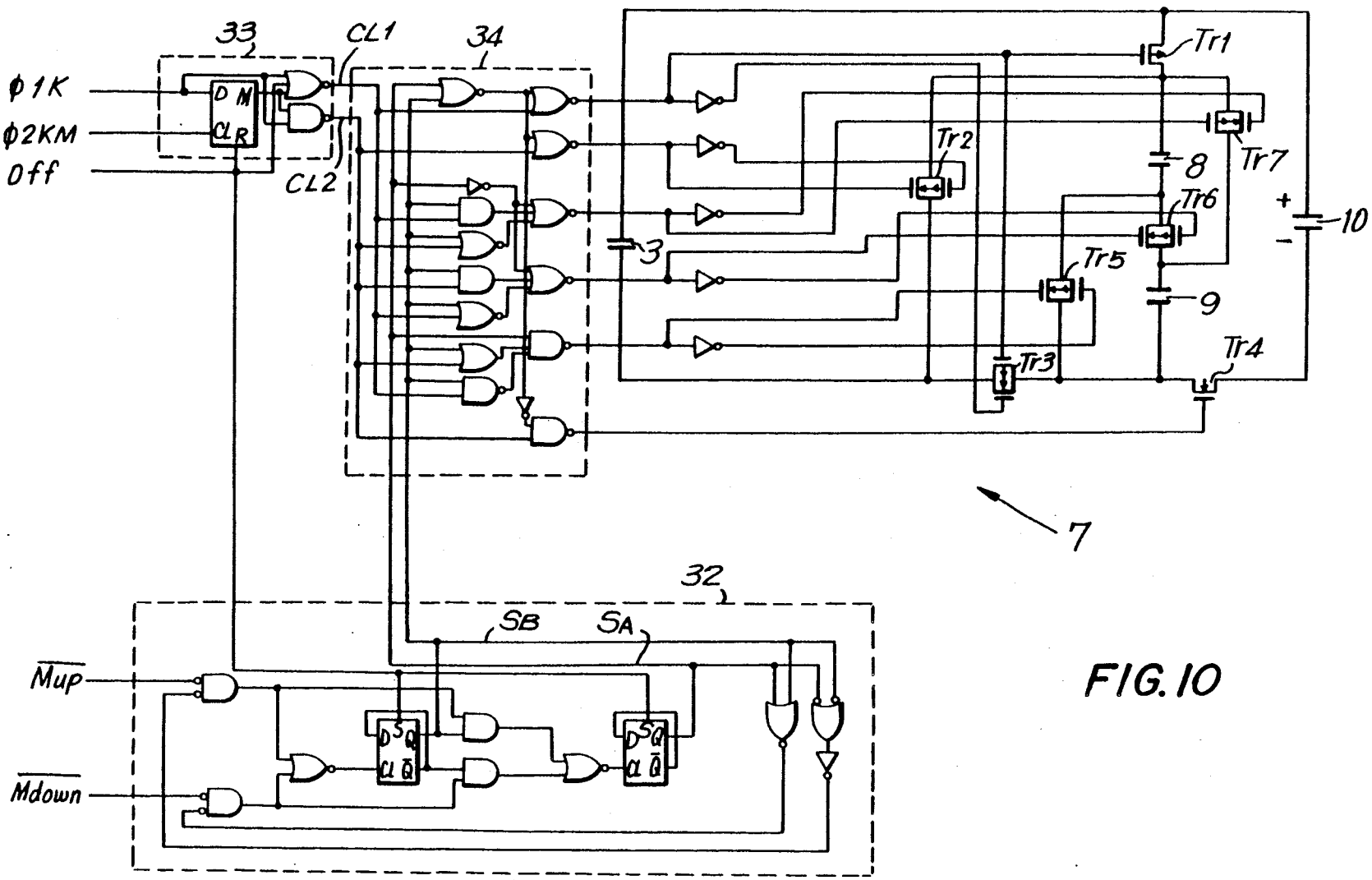
FIG. 10 is a multistage booster circuit.

Multistage booster circuit 7 is shown in greater detail in FIG. 10. A plurality of transistor $T_{r1}$ to $T_{r7}$ denote FETs for switching the connections between capacitors. Turning of the FETs ON/OFF is controlled by a boosting clock of 1 kHz. A well known up-down counter 32 is denoted in dashed lines. The four boosting factors are represented by the combination of 2-bit values from a pair of outputs $S_A$ and $S_B$ of up-down counter 32.

FIG. 11 shows the relationship between outputs $S_A$ and $S_B$ and the boosting factors. Referring once again to FIG. 10, $M_{up}$, which is one of two inputs to up-down counter 32, is produced by $V_{SS}$ detecting circuit 11 which is a clock pulse output when voltage $V_{SS}$ is below voltage $V_{up}$ (i.e. 1.2 V). A logic level of 0 is defined as being active. Similarly, $M_{down}$, which is the other input to up-down counter 32, is a clock pulse which is outputted when voltage $V_{SS}$ exceeds voltage $V_{down}$ (i.e. 2.0 V). The boosting factors are changed from one to another based on the output of $V_{SS}$ detecting circuit 11.

A logic signal of 0 refers to a minus (−) side (i.e. $V_{SS}$ side) of the auxiliary capacitor 10, while a logic signal of 1 refers to the +side (the $V_{DD}$ side) of auxiliary capacitor 10. A boosting reference signal generating circuit 33 outputs a pair of boosting reference signals CL1 and CL2 based on a pair of standard signals $\phi$1k and $\phi$KM which are outputted from a frequency divider (not shown). A switching control circuit 34 outputs a signal decoded from signals CL1, CL2, $S_A$ and $S_B$ to control the switching of transistors Tr1 to Tr7.

FIG. 12(A) illustrates standard signals $\phi$1K and $\phi$2KM inputted to and boosting reference signals CL1 and CL2 outputted from boosting reference generating circuit 33. FIGS. 12(B), 12(C), 12(D) and 12(E); illustrate multistage booster circuit 7 operation for each boosting factor in the form of timing charts. FIGS. 13(A), 13(B), 13(C) and 13(D) illustrate multistage booster circuit 7 operation for each boosting factor in the form of a equivalent capacitance diagram. In FIGS. 12(B), 12(C), 12(D) and 12(E) when a transistor Trn has a value of 1, it is turned on.

Figure 13A:
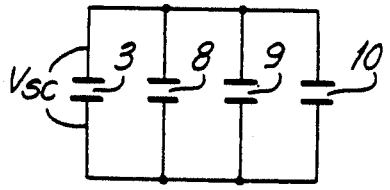
FIGS. 13(A), 13(B), 13(C) and 13(D) are equivalent capacitance circuits corresponding to FIGS. 12(A), 12(B), 12(C) and 12(D), respectively.

FIG. 12(B) shows the switching control signals for a boosting factor of 1.0. Transistors Tr1, Tr3, Tr4, Tr5 and Tr7 are constantly turned on. The equivalent capacitance circuit is shown in FIG. 13(A). More specifically, capacitors 3, 8, 9 and 10 are connected electrically in parallel, so that voltage $V_{SC}$ of capacitor 3 and voltage $V_{SS}$ of auxiliary capacitor 10 are equal to each other.

Figure 13B:
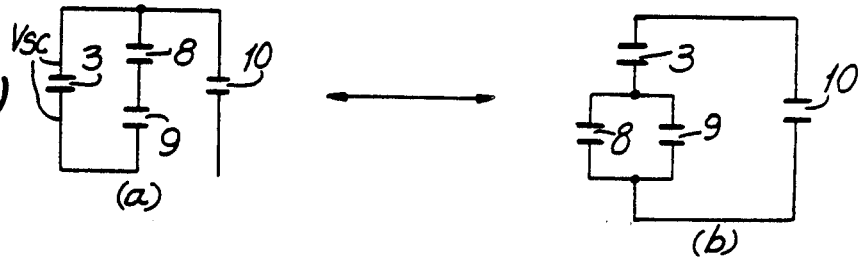

FIG. 12(C) shows the switching control signals for a boosting factor of 1.5. During interval (a), transistors Tr1, Tr3 and Tr6 are turned on, while during interval (b), transistors Tr2, Tr4, Tr5 and Tr7 are turned on. FIG. 13(B) is the equivalent capacitance circuit for a boosting factor of 1.5. During interval (a), boosting capacitors 8 and 9 are each charged by $0.5\times V_{SC}$, while during interval (b) auxiliary capacitor 10 is charged by the sum of $V_{SC}$ and $0.5\times V_{SC}$ (i.e., $1.5\times V_{SC}$).

Figure 13C:
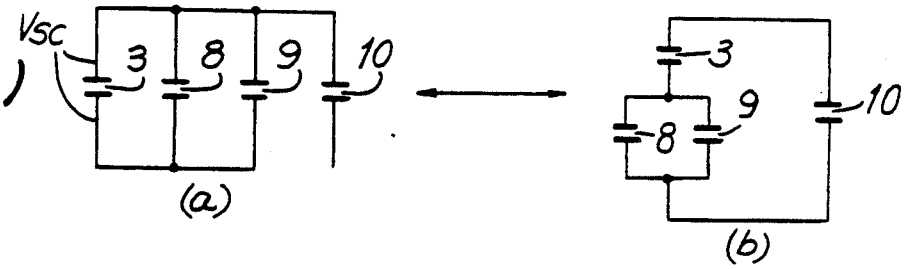

Similarly, FIGS. 12(D) and 13(C) show the operation for a boosting factor of 2.0. During interval (a), transistors Tr1, Tr3, Tr5 and Tr7 are turned on, while during interval (b) transistors Tr2, Tr4, Tr5 and Tr7 are turned on. As a result, auxiliary capacitor 10 is charged by $2\times V_{SC}$.

Figure 13D:
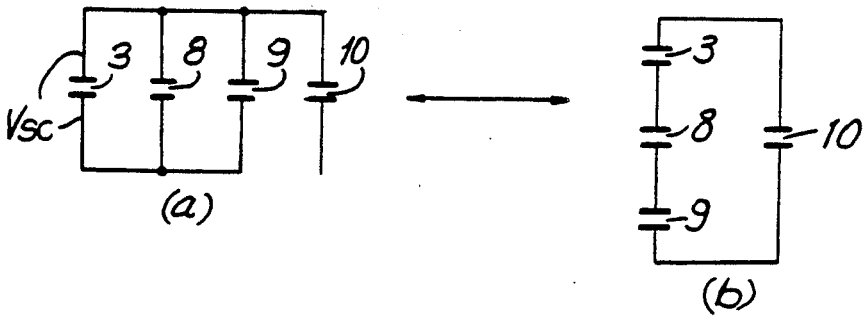

FIGS. 12(E) and 13(D) show the operation of multistage booster circuit 7 for a boosting factor of 3.0. During interval (a), transistors Tr1, Tr3, Tr5 and Tr7 are turned on, while during interval (b), transistors Tr2, Tr4 and Tr6 are turned on. As a result, auxiliary capacitor 10 is charged by $3\times V_{SC}$.

The signal "OFF" shown in FIG. 10 as being inputted to boosting reference signal generating circuit 33 has a logic level of 1 when $V_{SC}\leqq V_{on}$ (0.4 V), that is, when circuit 100 is in an immediate start state. At that time, the output of the boosting reference signal generating signal 33 turns off transistors Tr1 to Tr7. No boosting occurs. Both outputs $S_A$ and $S_B$ of up-down counter 32 are initially set at a logic level of 1 so that boosting is started from a boosting factor of 3.0 once the immediate start state is canceled. The immediate start state operation will be explained in detail below in connection with FIG. 16.

Figure 14:
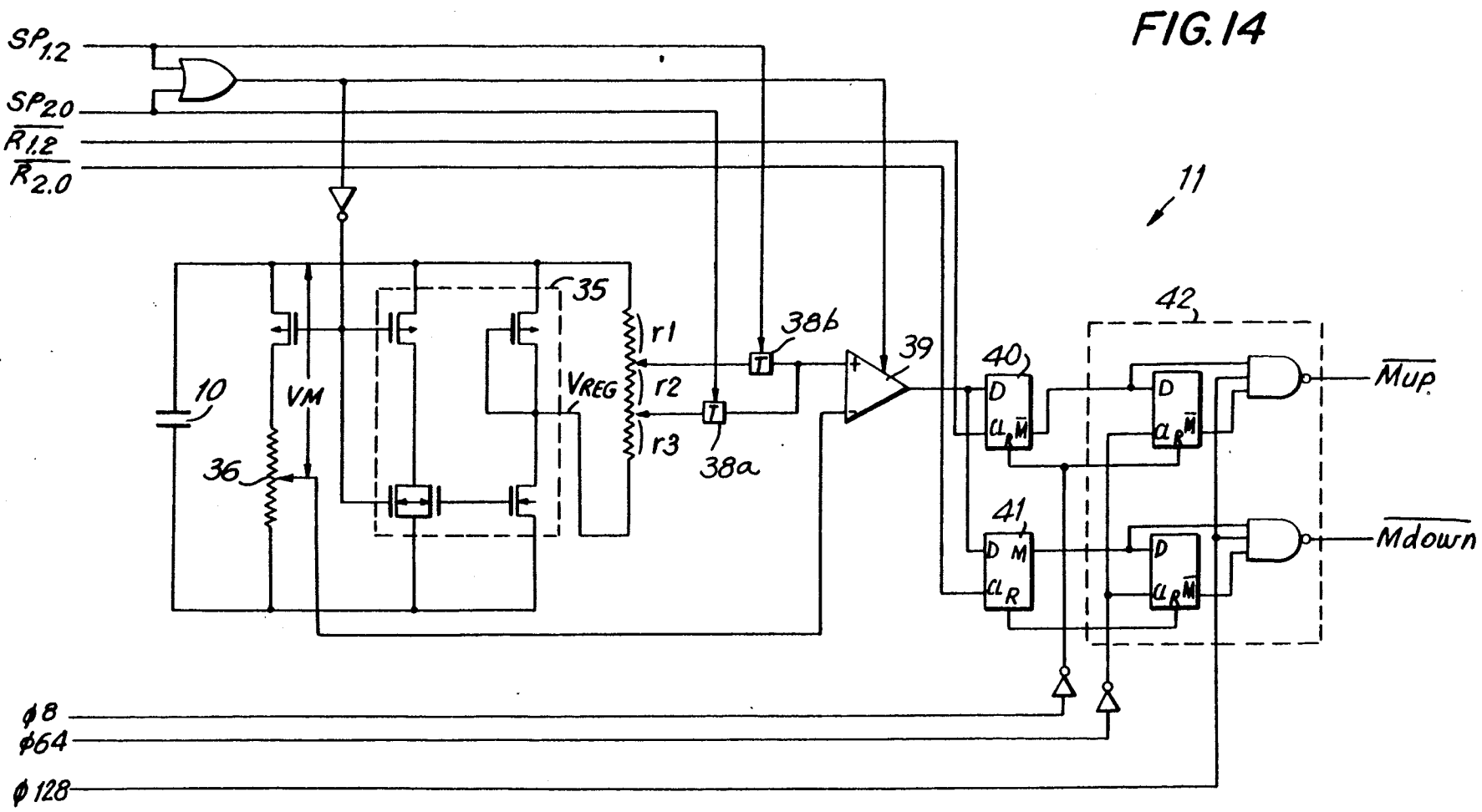
FIG. 14 is an auxiliary capacitor voltage detecting circuit.

FIG. 14 illustrates $V_{SS}$ detecting circuit 6. A pair of sampling signals $SP_{1.2}$ and $SP_{2.0}$, when at logic levels of 1, activate circuit 6. When signals $SP_{1.2}$ and $SP_{2.0}$ are at logic levels of 0, circuit 6 is brought into a fixed state so that no power is consumed therein. A well known constant-voltage circuit 35 denoted by dashed lines produces an output voltage $V_{REG}$. The voltage across a resistor 36 is used for detecting voltage $V_{SS}$ of auxiliary capacitor 10. The voltage across a resistor 37 is used for producing reference voltages associated with $V_{up}$ and $V_{down}$. Each intermediate tap of resistor 37 is set so that when $V_{SS}=1.2$ V, a voltage $V_m$ across a portion of resistor 36 is defined as follows:

$$V_m=V_{REG}(r_1/(r_1+r_3))$$

whereas, when $V_{SS}=2.0$ V, voltage $V_m$ is defined as $$V_m=V_{REG}(r_1+r_2)/(r_1+r_2+r_3))$$

A pair of transmission gates 38*a* and 38*b* are turned on by sampling signals $SP_{2.0}$ and $SP_{1.2}$ and switch between reference voltages representing $V_{up}$ and $V_{down}$, respectively. A comparator 39 compares the voltage from either one of gates 38*a* and 38*b* or 39 with the detected voltage from the tap of resistor 36 representing voltage $V_{SS}$. A master latch 40 latches the output of comparator 39 in response to the rise of signal $R_{1.2}$. Another master latch 41 latches the output of comparator 39 in response to the rise of a signal $R_{2.0}$ in the same way as master latch 40. A well known differentiating circuit 42 outputs either a clock pulse $M_{up}$ or $M_{down}$ when the contents of the master latches 40 and 41 change. A change in the contents of up-down counter 32 of FIG. 10 results. $\phi$8, $\phi$64 and $\phi$128 reference signals which ar ®outputted from a frequency divider. $\phi$8 is used to initialize master latches 40, 41 and a differentiating circuit 42 for subsequent sampling.

Figure 15:
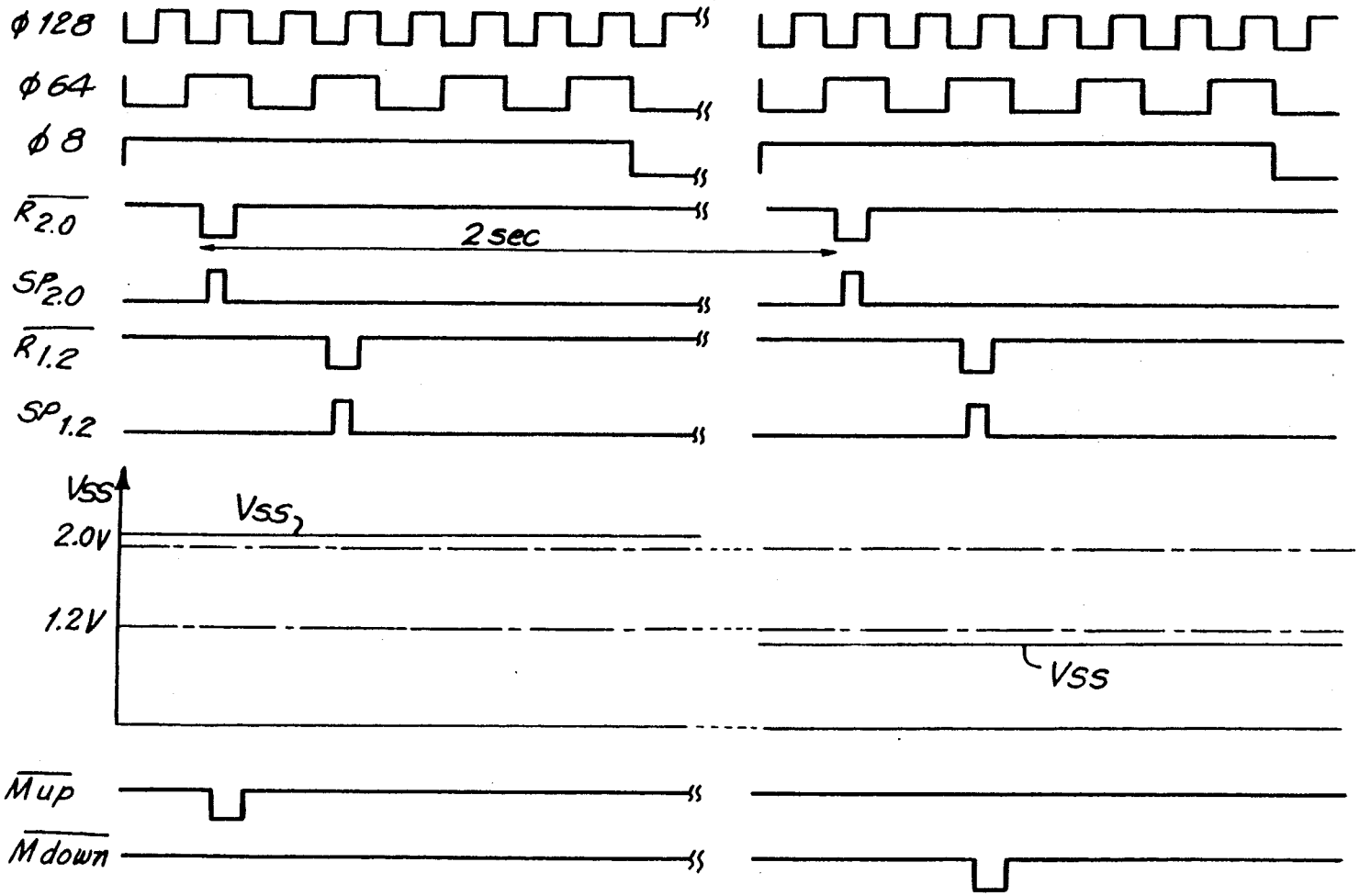
FIG. 15 is a fragmented timing diagram of FIG. 14.

Operation of $V_{SC}$ detecting circuit 6 is graphically illustrated by the timing chart of FIG. 15. The first half of FIG. 15 is a timing chart showing the operation of circuit 6 when voltage $V_{SS}>2.0$ V. The second half of FIG. 15 is a timing chart showing the operation of circuit 6 when voltage $V_{SS}<1.2$ V. Signals $R_{2.0}$, $SP_{2.0}$, $R_{1.2}$ and $SP_{1.2}$ are outputted once every 2 seconds from a sampling signal generating circuit (described below). When voltage $V_{SS}>2.0$ V, $M_{down}$ is outputted to step down the boosting factor by one level, whereas when $V_{SS}<1.2$ V, $M_{up}$ is outputted to step up the boosting factor by one level.

The immediate start circuit is provided to permit the boosting operation to start smoothly and reliably at a transistion point where voltage $V_{SC}$ changes from a voltage below 0.4 V to a voltage above 0.4 V. Boosting of voltage $V_{SC}$ begins at transistion point 0.4 V. For boosting to start, it is necessary that the oscillation circuit already should be in an oscillating state and the immediate start circuit already should be in an operative state. Voltage $V_{SC}$ at the transition point is low (i.e., 0.4 V) and voltage $V_{SS}$ has, as a matter of course, not been boosted before voltage $V_{SC}$ reaches the transition point. Therefore, circuit 100 cannot operate. If the transistion point is set at a voltage at which circuit 100 is already operable, introduction of the boosting system makes no sense.

Figure 16:
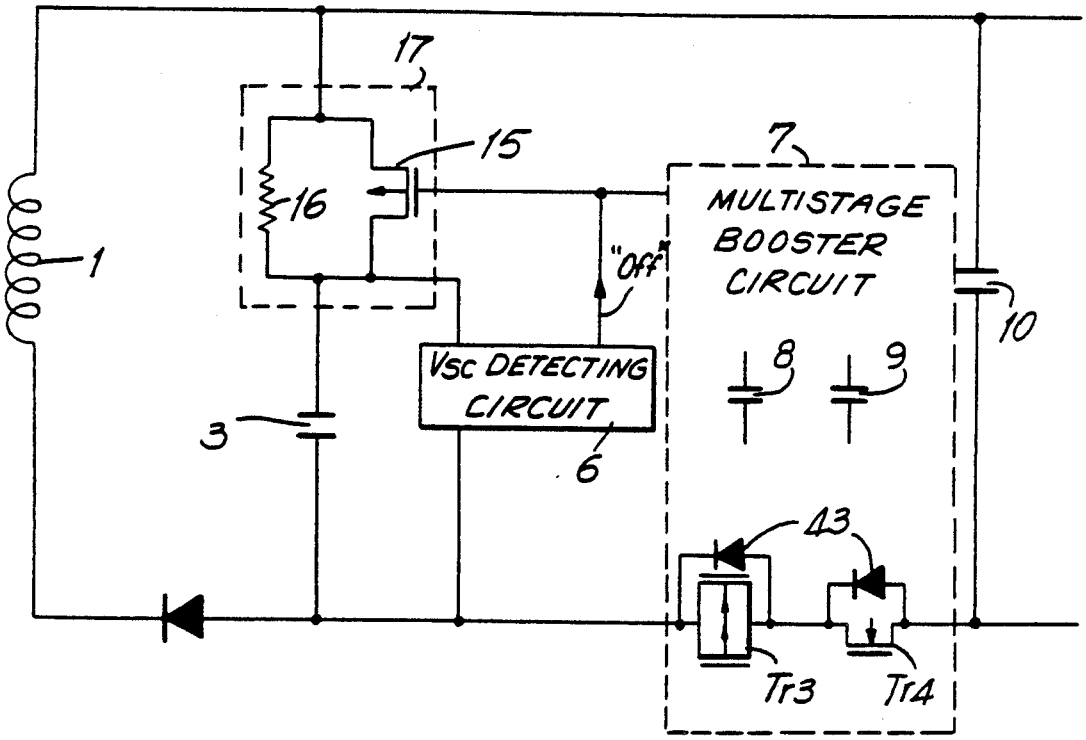
FIG. 16 is a block and circuit diagram of the electronic wristwatch during an immediate start state.

To solve the above-described problems, the immediate start circuit permits voltage $V_{SS}$ to be raised to a high voltage by a method which is different from that of booster circuit 7. Immediate start circuit 17 is shown in FIG. 16. When $V_{SC}<V_{on}$ (0.4 V) is detected by the $V_{SC}$ detecting circuit 6, the "off" signal assumes a logic level of 1, so that a shorting transistor 15 of circuit 17 turns off. Further, in response to the "off" signal, multistage booster circuit 7 is initially set and transistors Tr1 to Tr7 are turned off. When generator coil 1 is activated in this state, a charging current i flows through capacitor 3. A resistor 16 of circuit 17 which is connected electrically in parallel with transistor 15 and electrically in series with capacitor 3 now has a voltage drop v=the resistance (r) of resistor 16×current i. More specifically, a voltage of $v+V_{SC}$ is applied across the auxiliary capacitor 10 only when current i is flowing. Although transistors Tr3 and Tr4 are turned off at the time of the immediate start operation, auxiliary capacitor 10 can be charged with the voltage $V+V_{SC}$ through a pair of parasitic diodes 43 of these transistors.

Auxiliary capacitor 10 also serves as a smoothing capacitor. After auxiliary capacitor 10 has been charged to a level of $v+V_{SC}$, multistage circuit booster 7 operation begins. Resistance (r) of series resistor 16 should be chosen so that $r\times i=v$ is equal to or greater than $V_{on}$ (i.e. 1.2 V). The "off" signal is set in $V_{SC}$ detecting circuit 6 so that it is at a logic level of 1 even when oscillation is suspended. Hence, multistage booster circuit 7 is in an inoperative state. Therefore, no problem exists in starting of the immediate start circuit. When voltage $V_{SC}$ exceeds $V_{on}$ which initiates the boosting operation, shorting transistor 15 is turned on so that no excess impedance from resistor 16 affects the charging current following an immediate start operation. Therefore, voltage $V_{SS}$ can be charged to a high level of efficiency. Once voltage $V_{SC}$ exceeds the transition point with charging current i flowing, it is possible to commence an immediate start operation, that is, to raise voltage $V_{SS}$ to a high level at the transition point. Accordingly, the invention permits immediate start circuit system in an operative state prior to the transition point. Shift of circuit 100 to a boosting operation smoothly and reliably results. Further, according to the immediate start circuit of the invention, the watch is operable as long as the generator is in an operative state. Therefore, clock operation can be readily monitored even when the capacitor voltage is below 0.4 V. More specifically, a performance check can be carried out even though $V_{SC}$ is below 0.4 V when, for example, watches are shipped from the factory or in over-the-counter selling and PR work.

Figure 17:
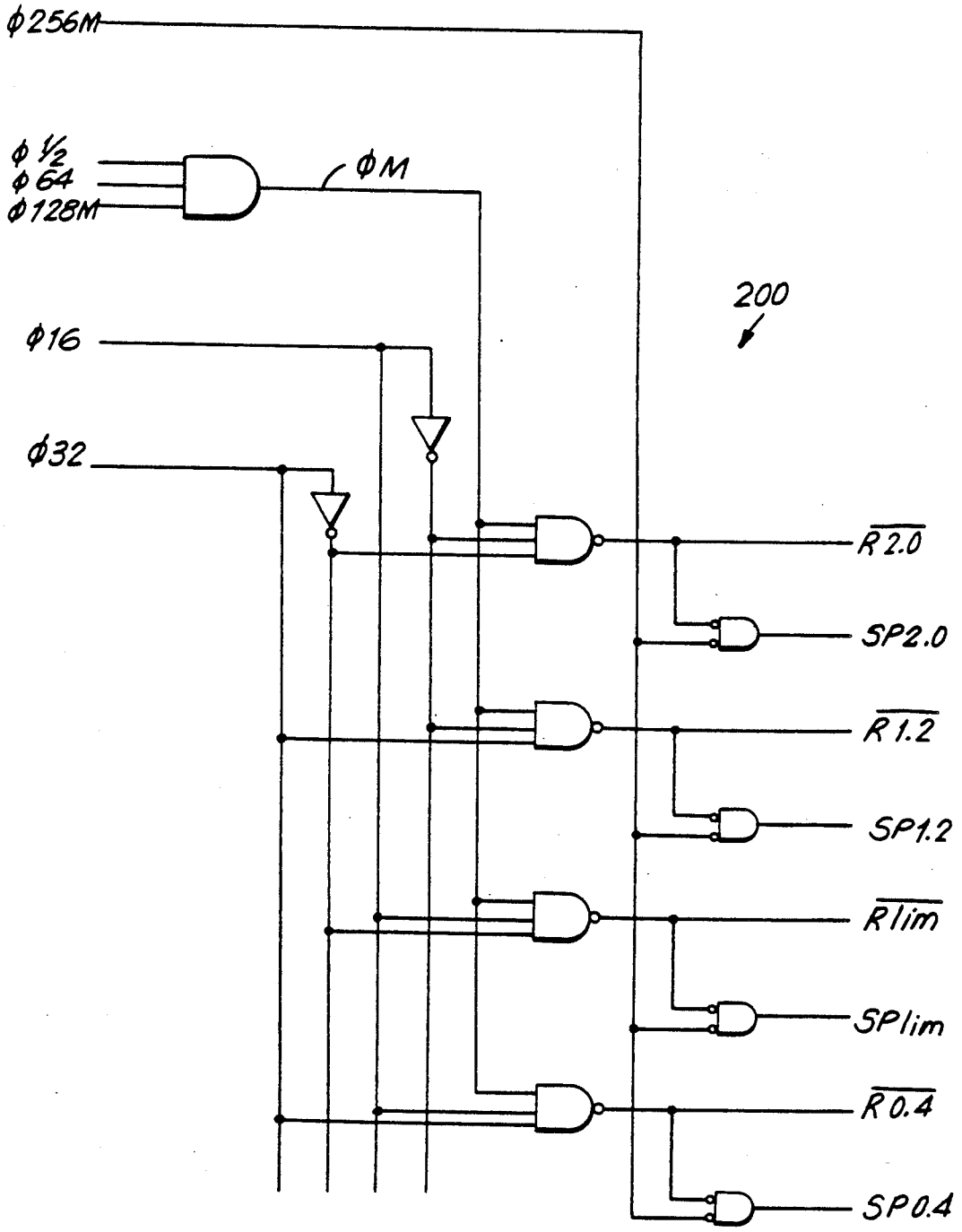
FIG. 17 is a logic diagram of a sampling signal generating circuit for voltage detection.

FIG. 17 shows a sampling signal generating circuit 200 for detecting four different kinds of voltage in circuit 100. The voltages detected include $V_{up}$ and $V_{down}$ in $V_{SS}$ detecting circuit 11 and $V_{on}$ and $V_{Lim}$ in $V_{SC}$ detecting circuit 6. $\phi$256M, $\phi\frac{1}{2}$, $\phi$64, $\phi$128M, $\phi$16 and $\phi$32 are reference signals which are outputted from a frequency divider (not shown). Each sampling signal is generated by decoding these reference signals. Signals $R_{2.0}$, $R_{1.2}$, $R_{Lim}$ and $R_{0.4}$ are sampling latch signals for comparators, respectively, while sampling signals $SP_{2.0}$, $SP_{1.2}$, $SP_{Lim}$, and $SP_{0.4}$ are used for activating detecting circuits associated with voltages $V_{down}$, $V_{up}$, $V_{Lim}$ and $V_{on}$, respectively.

Figure 18:
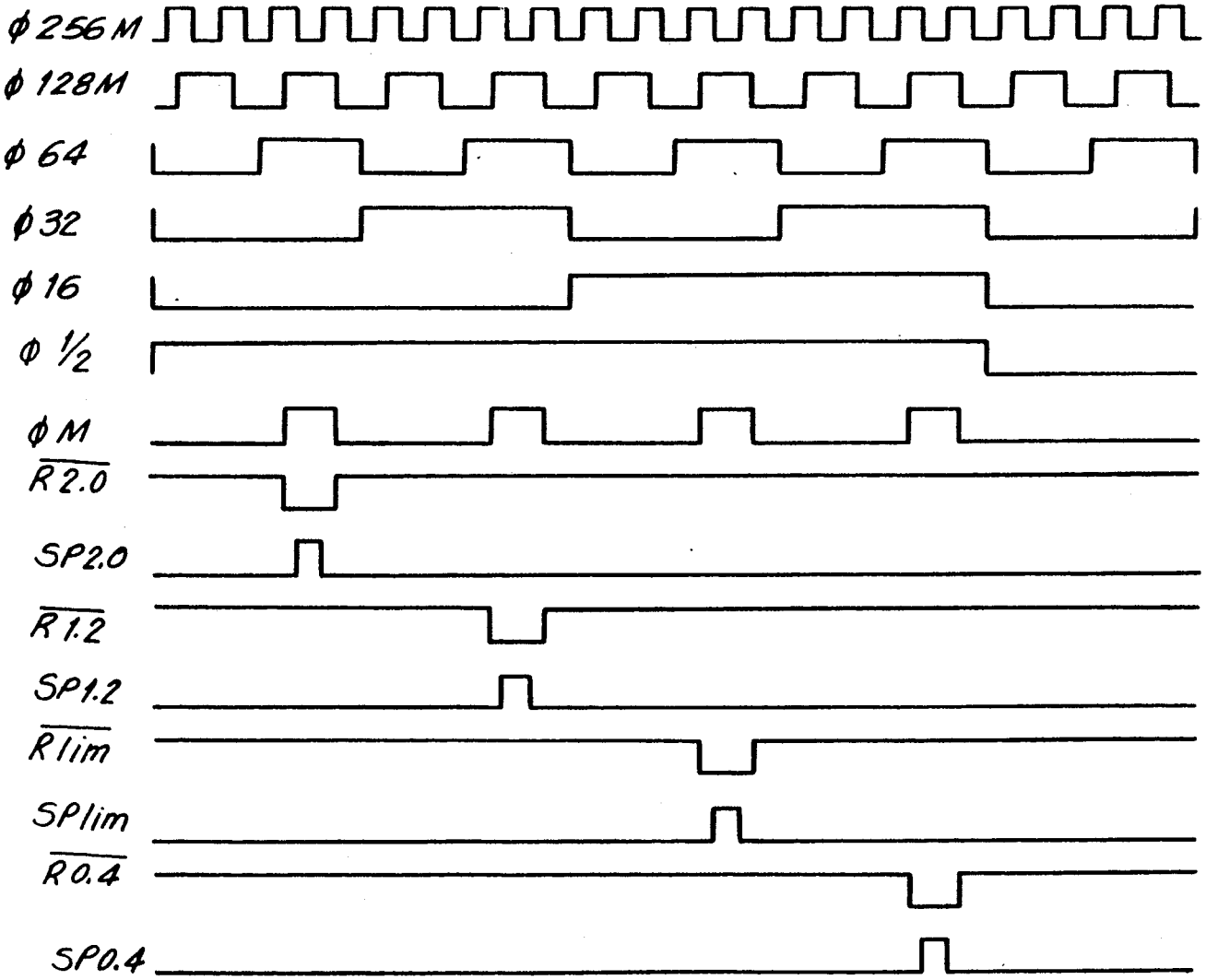
FIG. 18 is a timing diagram of the inputted clock signals and outputted sampling signals of FIG. 17.

FIG. 18 is a timing chart showing the process of generating the sampling signals. It is extremely effective to set the sampling pulses in the timing order shown in FIG. 18, and particularly the order of detection sampling signal $SP_{2.0}$ for stepping down the boosting factor by one level when $V_{SS}$ has reached $V_{down}$ (2.0 V) and sampling signal $SP_{0.4}$ for starting a boosting operation when $V_{SC}$ has reached $V_{on}$ (0.4 V).

Figure 19A:
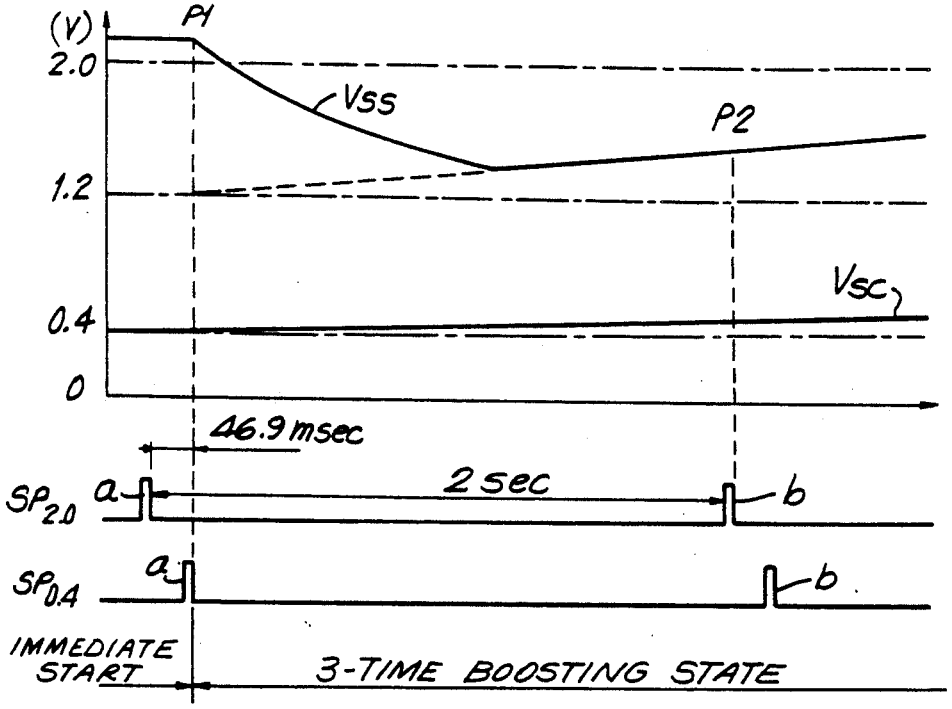
FIG. 19(A) and 19(B) are plots of voltages $V_{SS}$ and $V_{SC}$ and signals $SP_{2.0}$ and $SP_{0.4}$ at the time that an immediate start state is canceled.
Figure 19B:
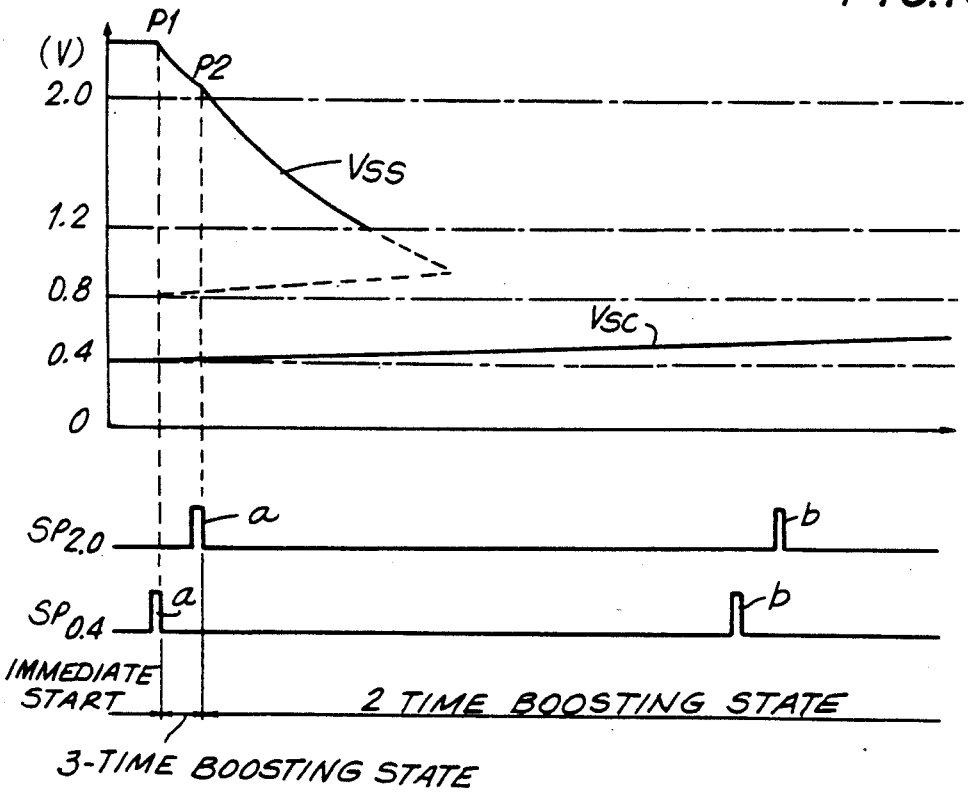

FIG. 19(A) shows the effect on voltage $V_{SS}$ in accordance with the sampling signal order of the invention. FIG. 19(B) shows the effect on voltage $V_{SS}$ where the sampling signal order is reversed. Referring first to FIG. 19(B), it is assumed that voltage $V_{SC}$ is lower than voltage $V_{on}$ (i.e. 0.4 V). Hence, the system is in an immediate start state before a pulse "a" of signal $SP_{0.4}$ (hereinafter referred to as pulse $SP_{0.4a}$) is outputted. It is further assumed that, when pulse $SP_{0.4a}$ is outputted, $V_{SC}\geqq V_{on}$ so that the immediate start state is canceled and boosting of $V_{SC}$ by a booster factor of 3.0 is commenced. At this time, voltage $V_{SS}$ decreases toward 1.2 V (0.4 V×3) from the voltage in the immediate start state voltage. Voltage $V_{SS}$, however, does not decrease in value instantaneously but decreases by a certan percentage within a certain RC time constant. If voltage $V_{SS}$ is at a sufficiently high level (i.e., $V_{SS}>2.0$ V) in the immediate start state, the following problem arises.

At a point P1, voltage $V_{SS}$ starts to decrease toward 1.2 V. When a pulse "a" of sampling signal $SP_{2.0}$ (hereinafter referred to as $SP_{2.0a}$) is outputted successively at point P2, if voltage $V_{SS}$ is still at a higher level than 2.0 V, a boosting state for boosting factor 2.0 is immediately commenced. Therefore, circuit 100 changes over from a boosting state with a boosting factor 3.0 to a boosting factor of 2.0 shortly after an immediate start state is canceled. Voltage $V_{SS}$ will decrease to 0.4 V×2=0.8 V, which is below the lower limit of the circuit operating voltage range, so that the clock circuit 12 is inactivated. Accordingly, clock circuit 12 cannot be activated again until voltage $V_{SC}$ is raised to 0.6 V by charging. Consequently and undesirably, the time required for the watch to begin operation is extended during this additional charging period. Voltage $V_{SC}$ is preferably set to 0.6 V so that even if a boosting state of factor 2.0 is commenced when an immediate start state is canceled, circuit 100 operation is ensured since $V_{SS}$ is 2×0.6 V=1.2 V.

As shown in FIG. 19(A), in accordance with this embodiment of the invention the foregoing problem is solved by reversing the order in which signals $SP_{2.0}$ and $SP_{0.4}$ are generated in FIG. 19(B). Therefore, the period beginning from signal $SP_{0.4a}$ is outputted until a subsequent signal $SP_{2.0a}$ is outputted is relatively long. The period is 2.0 sec.−0.047 sec.=1.953 sec. In FIG. 19(B), the period is 0.047 sec. Therefore, when signal $SP_{2.0a}$ is outputted, circuit 100 is still in the immediate start state and not subjected to the changeover of boosting factors whereas when signal $SP_{0.4a}$ is outputted subsequently, the immediate start state is canceled and a boosting state for a factor of 3.0 is commenced. Voltage $V_{SS}$ at point P1 begins to decrease toward 1.2 V. Since the period from signal $SP_{0.4a}$ to signal $SP_{2.0a}$ is sufficiently long (i.e., 1.953 sec.), voltage $V_{SS}$ is below 2.0 V at point P2 when a pulse b of signal $SP_{2.0}$ (hereinafter $SP_{2.0b}$) is outputted. In other words, when signal $SP_{2.0b}$ is outputted, no lowering of voltage $V_{SS}$ is required and the boosting factor can be maintained in a boosting state for a factor 3.0. The period from signal $SP_{0.4}$ to signal $SP_{2.0}$ is set so as to be longer than T(sec) which is obtained from the following expression:

$$((i \times r)+V_{on})-V_{on} \times N)e \times P(-(T/CR))+V_{on} \times N < V_{down}$$

wherein i: the maximum current value obtained from the a.c. generator r: the sum of the resistance of the series resistor 16 and the internal resistance of the capacitor 3

$V_{on}$: 0.4 V

N: the boosting factor (N=3 in this embodiment)

C: the capacitance value of the auxiliary capacitor 10

R: the equivalent resistance value of the switching transistor within multistage booster circuit 7

$V_{down}$: 2.0 V

Therefore, when the immediate start state is canceled, voltage $V_{SS}$ has been raised to a level of $i \times r + V_{on}$ charging and then decreases to a level of $V_{on} \times N(1.2\ V)$ with a time constant CR. The above expression conditions that the voltage $V_{SS}$ after T(sec) has elapsed from the time when the immediate start state is canceled is lower than voltage $V_{down}$ (2.0 V).

As now can be readily appreciated, the invention reliably shifts circuit 100 operation from an immediate start state to a boosting operation state by simply adjusting the timing at which each of the sampling pulses $SP_{2.0}$ and $SP_{0.4}$ is outputted. In terms of the logic, it is only necessary to adjust the decoding condition for sampling signal generating circuit 200 without any additional changes thereto. Consequently, when the capacitor voltage $V_{SC}$ is equal to or higher than 0.4 V, timepiece operation is available even if the generator is not in an operative state, which is the aim in introducing the booster circuit.

The invention also provides a rechargeable wristwatch that employs an a.c. generator which does not inhibit the design of the watch and which is operable over the entire voltage range of the secondary power supply voltage $V_{SC}$ and in which the rectifier circuit has a minimum number of diodes.

Circuitry for preventing overcharge of the secondary power supply is provided. Booster circuitry for boosting the voltage of the secondary power supply (i.e. $V_{SC}$) permits a relative short period of time for charging of the watch while extending the time during which the watch can operate without needing to be recharged.

It will thus be seen that the objects set forth above, among those made apparent from the preceding description, are efficiently attained and since certain changes may be made in carrying out the above method without departing from the spirit and scope of the invention, it is intended that all matter contained in the above description shall be interpreted as illustrative and not in a limiting sense.

It is also to be understood that the following claims are intended to cover all the generic and specific features of the invention herein described and all statements of the scope of the invention which as a matter of language, might be said to fall therebetween.

What is claimed is:

1. An electronic wristwatch comprising:

generating means for generating an alternating current;

rectifier means for rectifying the alternating current;

rechargeable secondary power supply means for storing electric power rectified by said rectifier means;

auxiliary capacitance means for storing electric power;

boosting means for transferring the electric power from said secondary power supply means to said auxiliary capacitance means and for increasing and decreasing the voltage of said secondary power supply means which is applied to said auxiliary capacitance means;

first detecting means for detecting when a maximum permissible voltage level and a minimum permissible voltage level are applied to said auxiliary capacitance means wherein said booster means is responsive to said first detecting means indicating the occurrence of said maximum permissible level and said minimum permissible level of voltage across said auxiliary capacitance means for decreasing and increasing the voltage applied by the boosting means to the auxiliary capacitance means, respectively; and clock circuitry means for maintaining time; said auxiliary capacitance means providing power to said clock circuitry means.

2. The electronic wristwatch of claim 1, wherein said first detecting means includes reference voltage means for providing a maximum permissible reference voltage and a minimum permissible reference voltage, sampling voltage means for providing a sampling voltage representative of the voltage across said auxiliary capacitance means, comparison means for comparing said maximum permissible reference voltage and said minimum permissible reference voltage to said sampling voltage and logic means for producing output signals based on said comparison and representing whether the voltage of said auxiliary capacitance means is at least greater than said maximum permissible voltage level or at least less than said minimum permissible voltage level.

3. The electronic wristwatch of claim 2, wherein said boosting means includes at least two booster capacitors, booster switching means and booster control means; said booster switching means responsive to said booster control means for rearranging the connections between said booster capacitors, said secondary power supply means and said auxiliary capacitance means wherein said booster control means is responsive to said output signals of said logic means.

4. The electronic wristwatch of claim 1, wherein the rectifier means includes a half-wave rectifier.

5. The electronic wristwatch of claim 1, wherein said overcharge limiting means includes antibraking means for minimizing the electromagnetic braking affect on the generating means.

6. The electronic wristwatch of claim 5, wherein the overcharge limiting means includes switching means for redirecting the flow of current produced by the generating means through the overcharge limiting means rather than through the secondary power supply means.

7. The electronic wristwatch of claim 6, wherein the switching means and antibraking means of the overcharged limiting means are electrically connected in series with each other and together are electrically connected in parallel with the generating means.

8. The electronic wristwatch of claim 7, wherein said antibraking means is a diode.

9. The electronic wristwatch of claim 1, wherein a diode serves as the rectifier means and is connected electrically in series with the secondary power supply means.

10. The electronic wristwatch of claim 6, wherein said switching means of the overcharge limiting means is responsive to said second detecting means indicating that said secondary power supply means is beyond and is not beyond its maximum permissible voltage level to switch to an electrically closed state and an electrically open state, respectively.

11. The electronic wristwatch of claim 6, wherein the immediate start means is connected electrically in series with the secondary power supply means.

12. The electronic wristwatch of claim 11, wherein the booster means is operable for permitting the sum of the voltages across said immediate start means and said secondary power supply means to be applied to said auxiliary capacitance means.

13. The electronic wristwatch of claim 12, wherein the immediate start means includes at least one resistor and switching means electrically connected in parallel, said switching means of the immediate start means responsive to the voltage level of the secondary power supply means being at or below said minimum permissible level of the latter.

14. The electronic wristwatch of claim 13, further including second detecting means for detecting when a maximum permissible voltage level and said minimum permissible voltage level of said secondary power supply means occurs, said switching means of said overcharge limiting means and said switching means of said immediate start means responsive to the second detecting means indicating the occurrence of said maximum permissible voltage level and minimum permissible voltage level of said secondary power supply means to switch from an electrically open state to an electrically closed state and from an electrically closed state to an electrically open state, respectively.

15. The electronic wristwatch of claim 14, wherein said boosting means is coupled between said secondary power supply means and said auxiliary capacitance means.

16. The electronic wristwatch of claim 14, further including activating generating means for producing a plurality of activating signals for activating said first detecting means and said second detecting means, one of said activating signals associated with the maximum permissible voltage level applied to said auxiliary capacitance means and another of said activating signals associated with the minimum permissible voltage level of said secondary power supply means wherein following termination in the operation of the immediate start means said activating signal associated with the maximum permissible voltage level applied to said auxiliary capacitance means is generated prior to generation of said activating signal associated with the minimum permissible voltage level of said secondary power supply and said intermediate start means is terminated in synchronization with said activating signal associated with the minimum permissible voltage level of said secondary power supply and whereby generation of the activating signal associated with the maximum permissible value of voltage applied to said auxiliary capacitance means occurs after the voltage level of said auxiliary capacitance means is less than its maximum permissible value thereof.

17. The electronic wristwatch of claim 14, further including activating generating means for producing a plurality of activating signals for activating said first and second detecting means wherein said second detecting means is activated prior to activation of said first detecting means.

18. The electronic wristwatch of claim 17, wherein the secondary power supply means has internal resistance and the boosting means has a switching transistor characterized by equivalent resistance and wherein the time interval between generating an activating signal for activating the second detecting means and generating an activating signal for activating the first detecting means is greater than the time interval (T) defined as follows:

$$((i\times r)+V_{on}-V_{on}\times N))e\times p(-(T/CR))+V_{on}\times N<V_{down}$$

wherein i: the maximum current value of the generating means;

r: the sum of the resistance of the immediate start means and the internal resistance of the secondary power supply means;

$V_{on}$: the minimum permissible value of voltage of the secondary power supply means;

N: the factor by which the boosting means changes the voltage of the secondary power supply means;

C: the capacitance value of the auxiliary capacitance means;

R: the equivalent resistance value of the switching transistor of the boosting means; and $V_{down}$: the maximum permissible voltage level of said auxiliary capacitance means.

19. An electronic wristwatch comprising:

generating means for generating an alternating current;

half-wave rectifier means for rectifying the alternating current;

rechargeable secondary power supply means for storing electric power rectified by said half-wave rectifier means;

overcharge limiting means for limiting the voltage applied to said secondary power supply means by said generating means and including antibraking means for minimizing the electromagnetic braking affect on the generating means and first switching means for redirecting the flow of current produced by the generating means through the overcharge limiting means rather than through the secondary power supply means;

auxiliary capacitance means for storing electric power;

clock circuitry powered by the voltage across the auxiliary capacitance means;

immediate start means coupled to the auxiliary capacitance means for increasing the voltage applied to the auxiliary capacitance means when the voltage of the secondary power supply means is at or below a minimum permissible level and including at least one resistor and second switching means electrically connected in parallel;

first detecting means for detecting and indicating when a maximum permissible voltage level and said minimum permissible voltage level of said secondary power supply means occur, said first switching means of said overcharged limiting means responsive to indication by said first detecting means that said maximum permissible voltage level of said secondary power supply means is present to switch to an electrically conductive state and said second switching means of said immediate start means responsive to indication by said first detecting means that the voltage level of the secondary power supply means is at or below its minimum permissible level to switch to an electrically open state;

boosting means operable for increasing and decreasing the voltage applied to the auxiliary capacitance means wherein the boosting means includes at least one booster capacitor, booster switching means and booster control means; said booster switching means responsive to said booster control means for rearranging the connections between the at least one booster capacitor, auxiliary capacitance means and secondary power supply means; and second detecting means for detecting and indicating when a maximum permissible voltage level and a minimum permissible voltage level are applied to said auxiliary capacitance means wherein said booster control means is responsive to indication by said second detecting means that said maximum permissible level and said minimum permissible level of voltage across the auxiliary capacitance means are present for controlling the decrease and increase of voltage applied by the boosting means to the auxiliary capacitance means, respectively.

20. An electronic wristwatch comprising:

a generator having at least a rotor, a stator, a coil and a mechanism for rotating said rotor to convert mechanical energy to electrical energy which includes an alternating voltage across the coil;

a rectifier circuit for rectifying the alternating voltage;

a rechargeable secondary power supply for storing the electric power rectified by said rectifier circuit; and an overcharge preventing circuit for preventing overcharge of said secondary power supply, wherein said overcharge preventing circuit includes switching means and rectifier means connected electrically in series and which together are connected electrically in parallel to said coil;

auxiliary capacitor means having a storage capacity less than said secondary power supply and for storing electric power; and clock circuitry means for maintaining time; said auxiliary capacitance means providing power to said clock circuitry means;

wherein said switching means are operable for switching between ON and OFF states, said switching means switching to the ON state when the voltage across the rechargeable secondary power supply reaches a predetermined maximum value and wherein said rectifier means is operable for controlling the direction of current flow through said switching means to prevent current flow through said switching means when said switching means is in the OFF state.

21. The electronic wristwatch of claim 20, further including load resistance means switchably connected electrically in series between said secondary power supply and said coil wherein said load resistance means and secondary power supply are operably coupled to said auxiliary capacitor means to apply the sum of the voltages across said load resistance means and secondary power supply means to said auxiliary capacitor means when said secondary power supply is less than or equal to a first predetermined level and whereby said sum of the voltages is at least equal to a second predetermined level.

22. The electronic wristwatch of claim 20, wherein said rectifier circuit comprises a first diode connected in series with said secondary power supply; said rectifier means of said overcharge preventing circuit is a second diode; each of said first and second diodes having cathodes and anodes, the cathodes of both diodes being connected to each other; the anode of said first diode connected to said secondary power supply; and the anode of said second diode connected to said switching means of said overcharge preventing circuit.

23. The electronic wristwatch of claim 21, further including charging control means and boosting means; said charging control means for controlling the charging of said boosting means based on whether said auxiliary capacitor means is at or below said second predetermined level of voltage or at or above a third predetermined level of voltage; said boosting means for increasing and decreasing the value of the voltage which is applied to said auxiliary capacitor means and which is based on the voltage of said secondary power supply.

24. The electronic wristwatch of claim 23, further including immediate start circuitry having variable resistance means for varying the resistance of said immediate start circuitry and further including first voltage detecting means for detecting the voltage of said secondary power supply and for comparing the voltage of said secondary power supply to said first predetermined voltage wherein said variable resistance means is responsive to said comparison.

25. The electronic wristwatch of claim 24, wherein said variable resistance means includes a resistor and shorting switching means connected in parallel wherein said shorting switching means and boosting means are responsive to said first voltage detecting means whereby said shorting switching means is turned off and said boosting means is inoperable for boosting voltage when the voltage of said secondary power supply is equal to or less than said first predetermined level and said shorting switching means is turned on and said boosting means is activated when the voltage of said secondary power supply is greater than said first predetermined level.

26. The electronic wristwatch of claim 25, wherein said boosting means is a multistage booster circuit having more than one boosting factor and includes means for switching from one boosting factor to another; and further including second voltage detecting means for detecting the voltage of said auxiliary capacitor means and for comparing the voltage of said auxiliary capacitor means to a pair of reference voltages representative of said second and third predetermined voltages; said second voltage detecting means including means for producing said reference voltages; wherein said charging control means controls the switching from one boosting factor to another based on the comparison by said second voltage detecting means.

27. The electronic wristwatch of claim 26, further including activating means for activating said first and second voltage detecting circuits at different times wherein said second voltage detecting circuit is always activated immediately after said first voltage detecting circuit has been activated.

28. The electronic wristwatch of claim 26, wherein the secondary power supply has an internal resistance and the boosting means has a switching transistor characterized by an equivalent resistance and wherein the time interval between activation of said first voltage detecting circuit after activation of said second voltage detecting circuit is greater than a time (T) defined as follows:

$$((i \times r) + V_{on} - V_{on} \times N) e \times p(-(T/CR)) + V_{on} \times N < V_{down}$$

wherein i: the maximum current value of the generators;

r: the sum of the resistance of the one resistor of the immediate start means and the internal resistance of the secondary power supply;

$V_{on}$: the minimum permissible value of voltage of the secondary power supply;

N: the factor by which the boosting means changes the voltage of the secondary power supply;

C: the capacitance value of the auxiliary capacitance means;

R: the equivalent resistance value of the switching transistor of the boosting means; and $V_{down}$: the maximum permissible voltage level of said auxiliary capacitance means.

* * * * *